US011913223B2

(12) United States Patent
Zhang et al.

(10) Patent No.: US 11,913,223 B2
(45) Date of Patent: Feb. 27, 2024

(54) INTERLOCKING BLOCKS AND ASSEMBLY OF INTERLOCKING STRUCTURES

(71) Applicant: Trustees of Dartmouth College, Hanover, NH (US)

(72) Inventors: Yinan Zhang, West Lebanon, NH (US); Devin J. Balkcom, Hanover, NH (US)

(73) Assignee: Trustees of Dartmouth College, Hanover, NH (US)

( * ) Notice: Subject to any disclaimer, the term of this patent is extended or adjusted under 35 U.S.C. 154(b) by 580 days.

(21) Appl. No.: 16/972,762

(22) PCT Filed: Jun. 7, 2019

(86) PCT No.: PCT/US2019/036056

§ 371 (c)(1),
(2) Date: Dec. 7, 2020

(87) PCT Pub. No.: WO2019/236999

PCT Pub. Date: Dec. 12, 2019

(65) Prior Publication Data

US 2021/0238846 A1 Aug. 5, 2021

Related U.S. Application Data

(60) Provisional application No. 62/682,652, filed on Jun. 8, 2018.

(51) Int. Cl.
*A63H 33/08* (2006.01)
*E04B 2/18* (2006.01)
(Continued)

(52) U.S. Cl.
CPC ..... *E04B 2/18* (2013.01); *E04B 2/08* (2013.01); *A63H 33/086* (2013.01);
(Continued)

(58) Field of Classification Search
CPC ..... A63H 33/04; A63H 33/06; A63H 33/08; A63H 33/082; A63H 33/084; A63H 33/086; A63H 33/088
See application file for complete search history.

(56) References Cited

U.S. PATENT DOCUMENTS 1,130,324 A * 3/1915 Owen ..... A63H 33/082 403/381
1,236,896 A * 8/1917 Anderson ..... A63J 19/00 446/124

(Continued)

FOREIGN PATENT DOCUMENTS

WO 2018/015902 A1 1/2018
WO 2019/236999 A1 12/2019

OTHER PUBLICATIONS

United States Patent and Trademark Office, International Search Report in International Application No. PCT/US2019/036056 (dated Aug. 15, 2019).

(Continued)

*Primary Examiner* — Kurt Fernstrom
(74) *Attorney, Agent, or Firm* — Neal, Gerber & Eisenberg LLP

(57) ABSTRACT

A set of interlocking blocks consists a plurality of first blocks and a plurality of second blocks capable of forming kinematic interlock. Each of the first blocks and second blocks comprise at least one male joint and female joint for mating with its counterpart. The motion of the first blocks and second blocks are constrained by joints. Subsequent first blocks and/or second blocks reinforce and immobilize prior first blocks and/or second blocks. Assembly of an interlock structure consisting the set of interlocking blocks may be performed via translation motions.

21 Claims, 16 Drawing Sheets

(51) Int. Cl.
*E04B 2/08* (2006.01)
*E04B 2/02* (2006.01)

(52) U.S. Cl.
CPC .... *A63H 33/088* (2013.01); *E04B 2002/0206* (2013.01); *E04B 2002/0208* (2013.01); *E04B 2002/0234* (2013.01)

(56) References Cited

U.S. PATENT DOCUMENTS 2,020,562 A * 11/1935 Miller ..... A63H 33/082 446/127
2,800,743 A * 7/1957 Clarence ..... A63H 33/084 446/127
3,339,294 A * 9/1967 Byrnes ..... A63H 33/04 29/418
4,202,131 A * 5/1980 Poleri ..... A63H 33/082 446/125
4,964,833 A * 10/1990 Suzuki ..... A63H 33/086 446/128
5,685,120 A * 11/1997 Sihra ..... A63H 33/06 273/156
5,853,314 A * 12/1998 Bora ..... A63H 33/086 446/124
7,882,674 B2 * 2/2011 Craven ..... E04C 1/397 446/124
2004/0102132 A1 * 5/2004 Miller ..... A63H 33/082 446/125
2020/0171400 A1 * 6/2020 Felix ..... A63H 33/082

OTHER PUBLICATIONS

United States Patent and Trademark Office, Written Opinion of The International Searching Authority in International Application No. PCT/US2019/036056 (dated Aug. 15, 2019).

* cited by examiner

INTERLOCKING BLOCKS AND ASSEMBLY OF INTERLOCKING STRUCTURES

CROSS REFERENCE TO RELATED APPLICATIONS

This patent application is a National Stage Entry of International Patent Application No. PCT/US2019/036056, filed on Jun. 7, 2019, which claims priority to U.S. Provisional Patent Application No. 62/682,652, filed on Jun. 8, 2018, the entire contents of which are fully incorporated herein by reference.

TECHNICAL FIELD

The present invention relates to interlocking blocks and the assembly of interlocking structures from such blocks.

BACKGROUND

Furniture, buildings, and machines are typically built out of smaller pieces, allowing complex structures to be built from a small selection of easily manufacture-able parts. These smaller parts form a language for the design of devices; the range of what can be built depends on what parts are available.

Systems like Legos are designed to allow physical experimentation, assembly, and prototyping at larger scales. However, these systems often rely on frictional locking that can be hard to achieve, and unreliable for large systems when external forces are applied.

Moreover, construction in human unfriendly environments, such as under water or outer space, may require robotics to implement. Traditional bricks are hard for robots to handle at least because they require cement to firmly connect with each other.

3D printing can be an alternate technology for construction. However, current 3D printers are not convenient for building large-scale structures, as construction requires the 3D printer to be larger than the structure and the construction is sequential.

Therefore, there is a need for modular components to enable robotic assembly of large structures and, in particular, a small set of modular components to enable assembly of a tightly interlocked structure and/or to enable assembly with pure translations and requiring substantially no adhesive materials.

SUMMARY

This disclosure provides a set of interlocking blocks. In certain embodiments, the set of interlocking blocks consists of two—and only two—types of blocks. In certain embodiments, the set of interlocking blocks consists of a plurality of first blocks and a plurality of second blocks.

In some such embodiments, each first block has a substantially cubic shape including six faces. The six first block faces include: (1) a first face including a central male joint, the central male joint located approximately centrally on the first face and configured for penetrating connection to a female joint; (2) a second face including a central female joint, the central female joint located approximately centrally on the second face, configured for penetrating connection to a male joint, and allowing for disassembly only in an opposing non-penetrating direction; (3) a third face including a first edge-associated male joint, the first edge-associated male joint located substantially along an edge of the third face and configured for tangential connection to an edge-associated female joint; and (4) a fourth face including a first open-ended female joint, the first open-ended female joint configured for penetrating or tangential connection to a male joint and allowing for disassembly in an opposing non-penetrating direction or an opposing tangential direction.

In some such embodiments, each second block has a substantially square cuboid shape including six faces. The six second block faces include a first rectangular face having an upper portion and a lower portion. The upper portion of the first rectangular face includes a plurality of first edge-associated female joints, each first edge-associated female joint located substantially along an edge of the upper portion of the first rectangular face and configured for tangential connection to an edge-associated male joint. The lower portion of the first rectangular face includes a lower rectangular face central male joint. The lower rectangular face central male joint is located approximately centrally on the lower portion of the first rectangular face and is configured for penetrating connection to a female joint. The six second block faces further include a second rectangular face having an upper portion and a lower portion. The upper portion of the second rectangular face includes a plurality of second edge-associated female joints. Each second edge-associated female joint is located substantially along an edge of the upper portion of the second rectangular face and is configured for tangential connection to an edge-associated male joint. The lower portion of the second rectangular face includes a lower rectangular face central female joint. The lower rectangular face central female joint is located approximately centrally on the lower portion of the second rectangular face and is configured for penetrating connection to a male joint and allowing for disassembly only in an opposing, non-penetrating direction. The six second block faces includes a first square face. The first square face includes a square face central female joint. The square face central female joint is located approximately centrally on the first square face and is configured for penetrating connection to a male joint and allowing for disassembly only in an opposing, non-penetrating direction. The first square face further includes a plurality of square face edge-associated female joints, each square face edge-associated female joint located substantially along an edge of the first square face, configured for tangential connection to an edge-associated male joint.

BRIEF DESCRIPTION OF THE DRAWINGS

For a better understanding of the invention, reference may be made to embodiments shown in the following drawings. The components in the drawings are not necessarily to scale and related elements may be omitted, or in some instances proportions may have been exaggerated, so as to emphasize and clearly illustrate the novel features described herein. In addition, system components can be variously arranged, as known in the art. Further, in the drawings, like reference numerals designate corresponding parts throughout the several views.

DETAILED DESCRIPTION OF EXAMPLE EMBODIMENTS

Figure 1A:
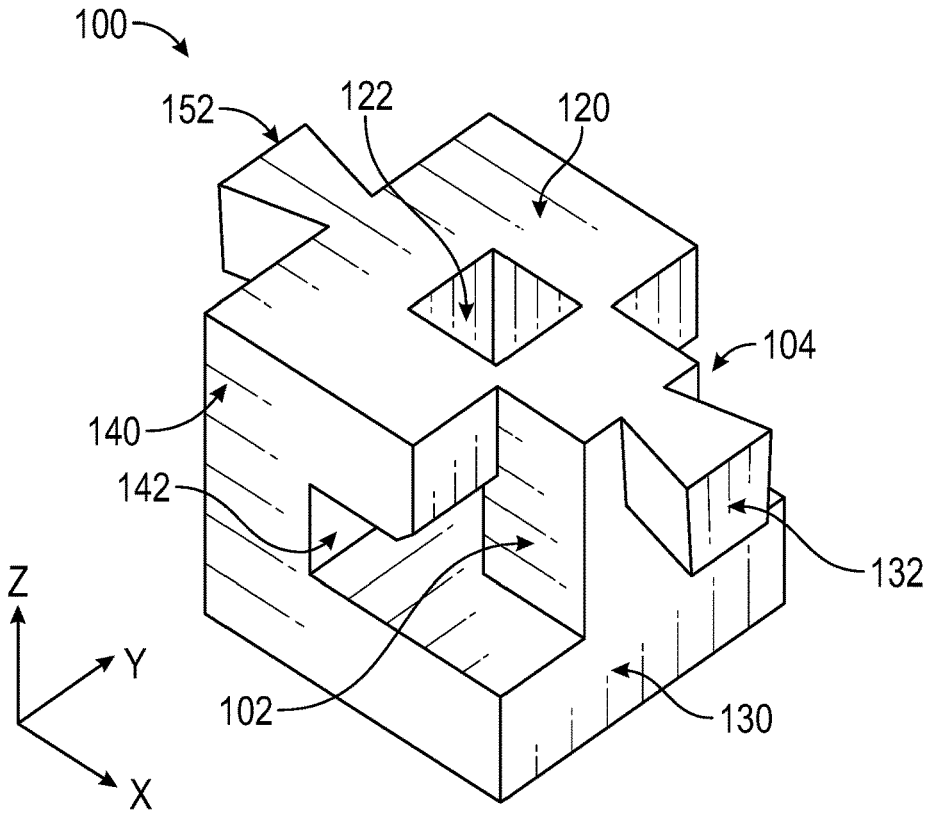
FIGS. 1A-1D illustrate a plurality of perspective views of a first block in accordance with this disclosure.
Figure 1B:
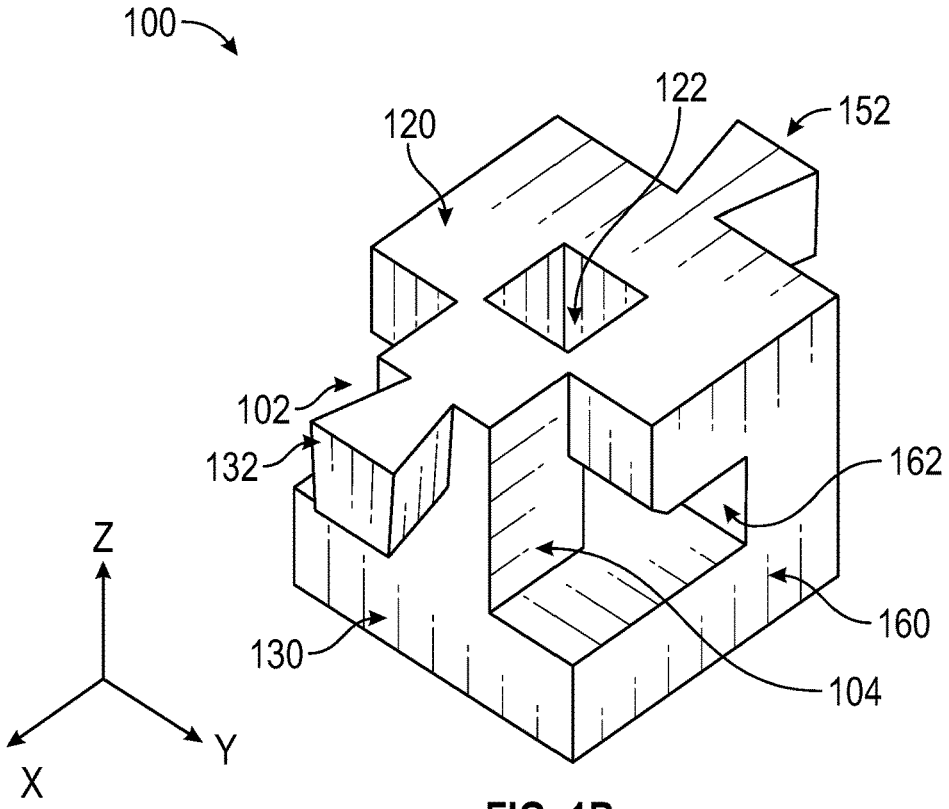
Figure 1C:
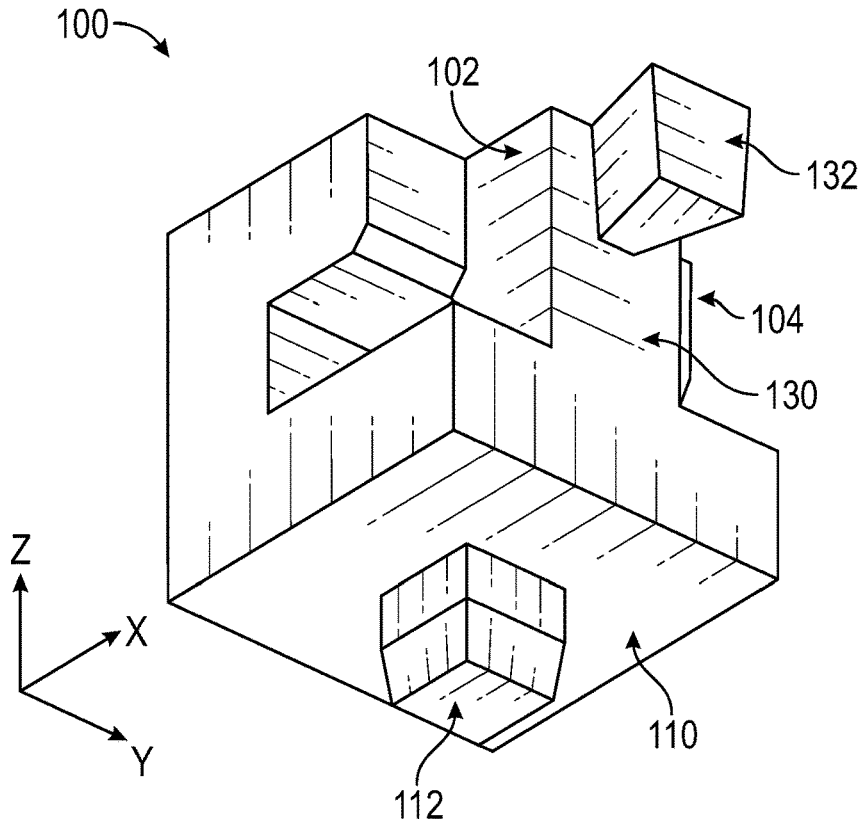
Figure 1D:
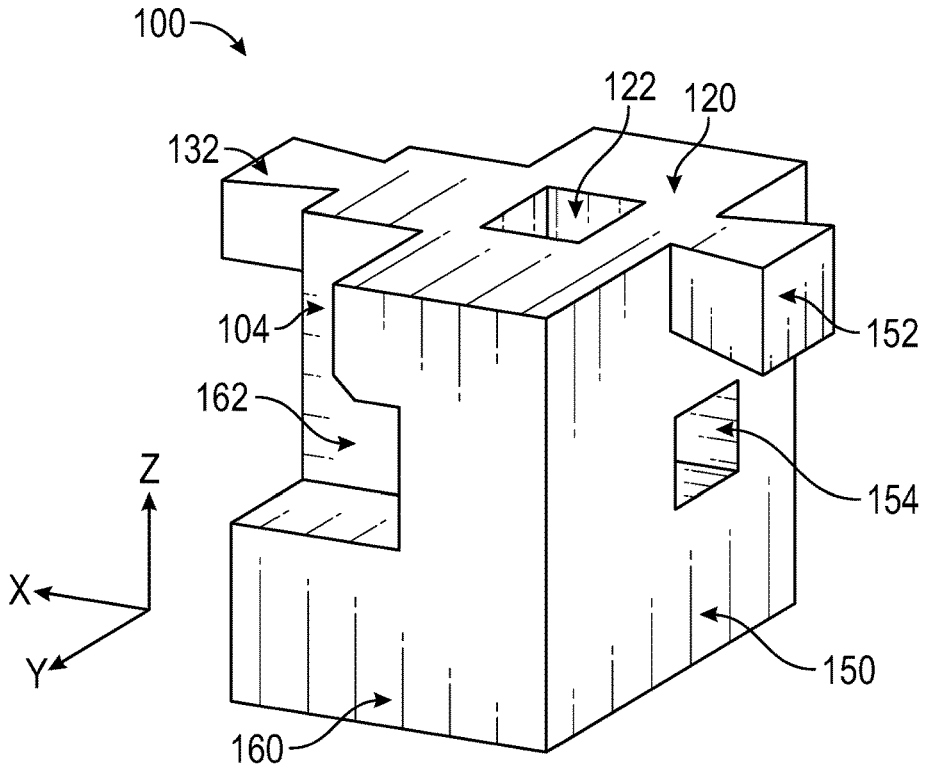

While the invention may be embodied in various forms, there are shown in the drawings, and will hereinafter be described, some exemplary and non-limiting embodiments, with the understanding that the present disclosure is to be considered an exemplification of the invention and is not intended to limit the invention to the specific embodiments illustrated.

A system and method described herein enable robotic assembly of large structures from blocks that interlock without the need for glue, cement, screws, or other connectors. The motion of blocks are constrained by joints. Later blocks reinforce and immobilize prior blocks. Each structure has a few blocks that can move, called keys. If the keys are immobilized, the structure is rigidly interlocked.

Kinematic interlock presents some advantages over traditional connection methods such as glue, cement, screws, nails, or friction locks. The interlocks may be structurally strong, allow simple assembly by robots, allow disassembly and re-use of the components, and may be suitable for underwater or other environments where adhesives are ineffective. Relative to 3D printing, fabricating in parts may present some advantages. Individual components may be fabricated efficiently, packed for storage and transport, repaired or replaced as needed, and allow design changes.

The system and method takes a voxelized 3D model as input, and finds an assembly plan such that the interlocked structure covers the specified voxels. There are two types of block: a 1×1×1 first block, and a 1×1×2 second block, with connectors arranged in a particular way. The assembly requires only translation motions.

FIGS. 1A-1D illustrate a plurality of perspective views of the first block 100 in accordance with this disclosure.

The first block 100 is a unit-cube sized block. The first block 100 may be a cubic-shaped block. The first block 100 includes six faces 110, 120, 130, 140, 150, and 160.

The first face 110 defines a central male joint. The central male joint 112 is located centrally or approximately centrally on the first face 110. The central male joint 112 may penetrate the female joint. In certain embodiments, the central male joint 112 may be a tenon tongue, which may conjoin with a mortise hole to form a mortise and tenon joint. The mortise and tenon joint allows blocks to be dissembled only in the non-penetrating normal direction of a contact surface. The mortise and tenon joints fully constrain rotational motion. The second face 120 opposes the first face 110.

The second face 120 includes a first central female joint 122. The first central female joint 122 is located centrally or approximately centrally on the first face 110. The first central female joint 122 may be receive a male joint. The first central female joint 122 allows disassembly only in an opposing non-penetrating direction. In certain embodiments, the first central female joint 122 may be a mortise hole.

The third face 130 includes a first edge-associated male joint 132. The first edge-associated male joint 132 is located along or located substantially along an edge of the third face 130. Said edge may be defined by the second face 120 and the third face 130. The first edge-associated male joint 132 may form tangential connection to an edge-associated female joint. The first edge-associated male joint 132 may be a pin, which may conjoin with a set of tails to form a dovetail joint. The dovetail joint allows a block motion only in a particular tangential direction. The dove tail joint fully constrain rotational motion. The third face 130 may define two voids. These voids may be cuboid or substantially cuboid. The first void 102 may be defined by a portion of the first block 100 connecting the second face 120, the third face 130, and the fourth face 140. The second void 104 may be defined by another portion of the first block 100 connecting the second face 120, the third face 130, and the sixth face 160. The third face 130 opposes the fifth face 150.

The fourth face 140 including a first open-ended female joint 142. The first open-ended female joint 142 may form penetrating and/or tangential connection with a male joint. The first open-ended female joint 142 allows disassembly in an opposing non-penetrating direction and/or an opposing tangential direction. The first open-ended female joint 142 may be defined by a first partial mortise hole and the first void 102. The first partial mortise hole may be located centrally or substantially centrally on the fourth face 140. The first open-ended female joint 142 may be a two-way joint. The two-way joint allows motions of associated block in both normal and tangential directions. The two-way joint allows one rotational degree of freedom. The fourth face 140 opposes the sixth face 160.

The fifth face 150 includes a second edge-associated male joint 152. The second edge-associated male joint 152 is located along or located substantially along an edge of the fifth face 150. Said edge may be defined by the second face 120 and the fifth face 150. The second edge-associated male joint 152 may form tangential connection to an edge-associated female joint. The second edge-associated male joint 152 may be a pin. The fifth face 150 further includes a second central female joint 154. The second central female joint 154 is located centrally or approximately centrally on the fifth face 150. The second central female joint 154 may be receive a male joint. The second central female joint 154 may allow disassembly only in an opposing non-penetrating direction. In certain embodiments, the second central female joint 154 may be a mortise hole.

The sixth face 160 includes a second open-ended female joint 162. The second open-ended female joint 162 may form penetrating and/or tangential connection with a male joint. The second open-ended female joint 162 allows disassembly in an opposing non-penetrating direction and/or an opposing tangential direction. The second open-ended female joint 162 may be defined by a second partial mortise hole and the second void 104. The second partial mortise hole may be located centrally or substantially centrally on the sixth face 160. The second open-ended female joint 162 may be a two-way joint.

Figure 2A:
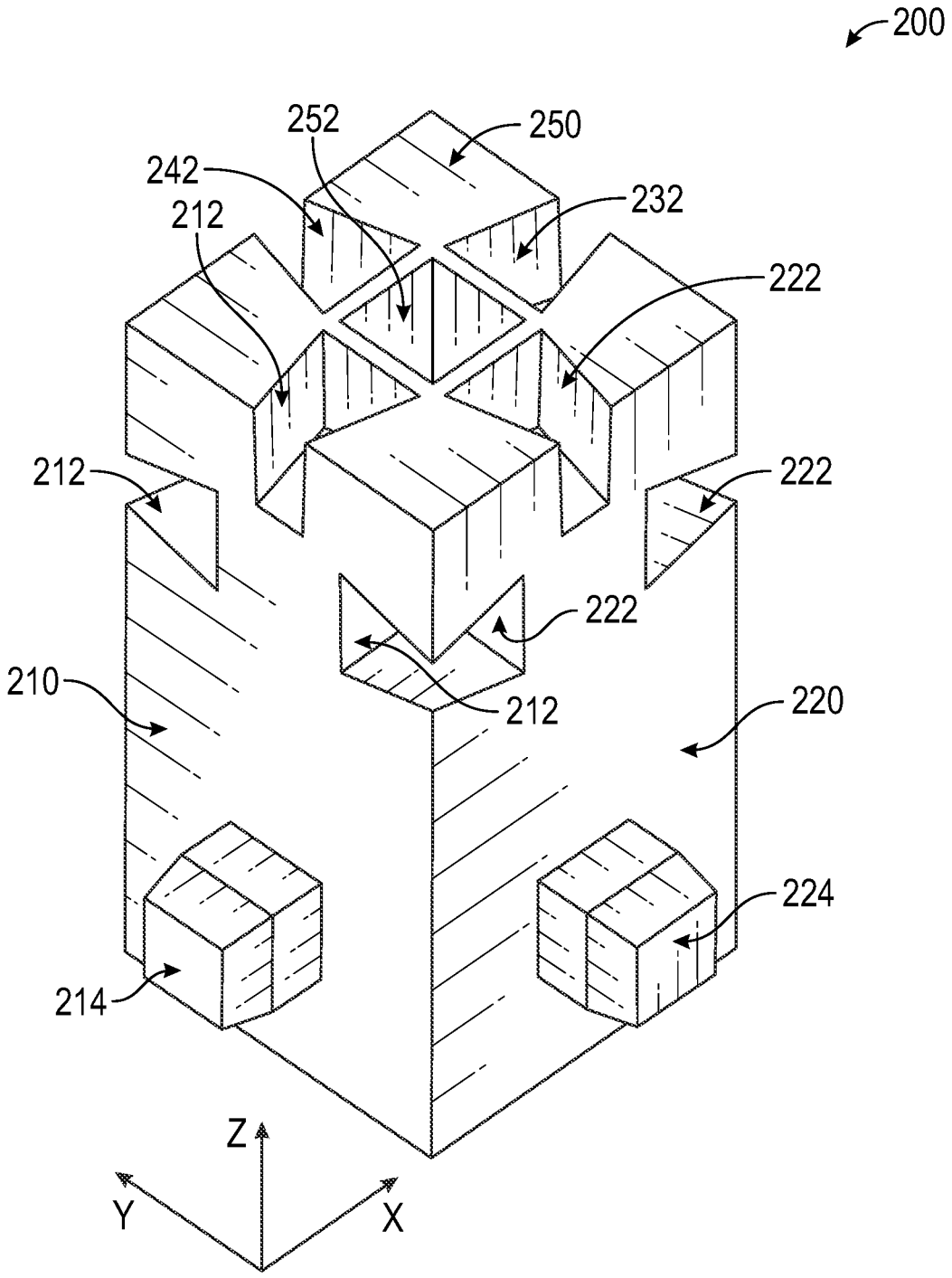
FIGS. 2A-2B illustrate a plurality of perspective views of a second block in accordance with this disclosure.
Figure 2B:
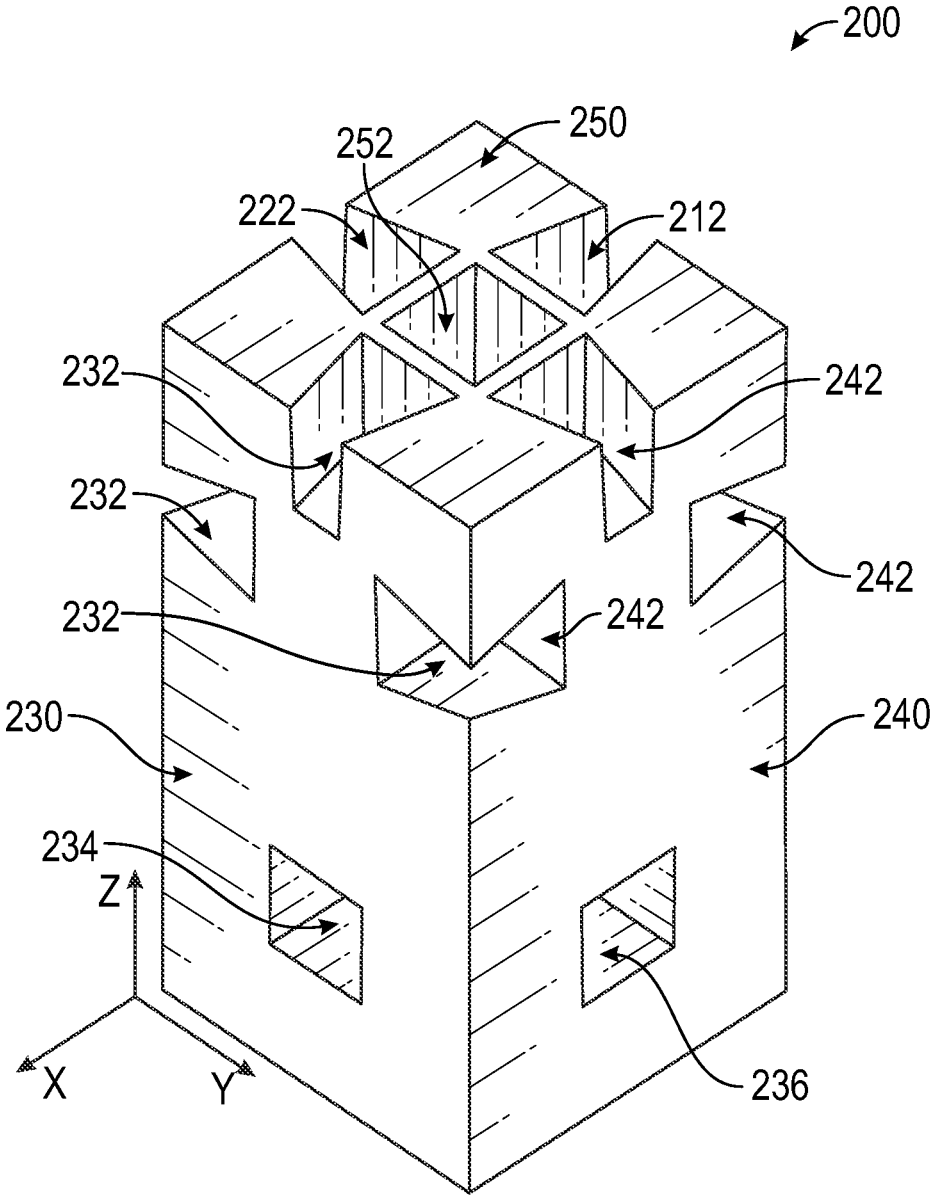

FIGS. 2A-2B illustrate a plurality of perspective views of the second block 200 in accordance with this disclosure.

The second block 200 is a two-unit high block. The first block 100 may be a cuboid-shaped block. The second block 200 includes four rectangular faces 210, 220, 230, and 240 and a first square face 250.

The first rectangular face 210 includes an upper portion and a lower portion. The upper portion of the first rectangular face 210 includes a plurality of first edge-associated female joints 212. Each of the plurality of first edge-associated female joints 212 may be a dovetail slot. Each of the plurality of first edge-associated female joints 212 may be located substantially along an edge of the upper portion of the first rectangular face 210 and may form tangential connection with an edge-associated male joint. One of the plurality of first edge-associated female joints 212 may be located on an edge defined by the first rectangular face 210 and the first square face 250. Said first edge-associated female joint 212 allows tangential connection with an edge-associated male joint along a direction that is normal to the surface of the first rectangular face 210. Two of the plurality of first edge-associated female joints 212 may be located on one edge defined by the first rectangular face 210 and the fourth rectangular face 240 and another edge defined by the first rectangular face 210 and the second rectangular face 220, respectively. The lower portion of the first rectangular face 210 includes a first lower rectangular face central male joint 214. The first lower rectangular face central male joint 214 is located centrally on or approximately centrally on the lower portion of the first rectangular face 210. The first lower rectangular face central male joint 214 may form penetrating connection with a female joint. The first lower rectangular face central male joint 214 may be a tenon tongue. The first rectangular face 210 opposes the third rectangular face 230.

The second rectangular face 220 includes an upper portion and a lower portion. The upper portion of the second rectangular face 220 includes a plurality of second edge-associated female joints 222. Each of the plurality of second edge-associated female joints 222 may be a dovetail slot. Each of the plurality of second edge-associated female joints 222 may be located substantially along an edge of the upper portion of the second rectangular face 220 and may form tangential connection with an edge-associated male joint. One of the plurality of second edge-associated female joints 222 may be located on an edge defined by the second rectangular face 220 and the first square face 250. Said second edge-associated female joint 222 allows tangential connection with an edge-associated male joint along a direction that is normal to the surface of the second rectangular face 220. Two of the plurality of second edge-associated female joints 222 may be located on one edge defined by the second rectangular face 220 and the first rectangular face 210 and another edge defined by the second rectangular face 220 and the third rectangular face 230, respectively. The lower portion of the second rectangular face 220 includes a second lower rectangular face central male joint 224. The second lower rectangular face central male joint 224 is located centrally on or approximately centrally on the lower portion of the second rectangular face 220. The second lower rectangular face central male joint 224 may form penetrating connection with a female joint. The second lower rectangular face central male joint 224 may be a tenon tongue. The second rectangular face 220 opposes the fourth rectangular face 240.

The third rectangular face 230 includes an upper portion and a lower portion. The upper portion of the third rectangular face 230 includes a plurality of third edge-associated female joints 232. Each of the plurality of third edge-associated female joints 232 may be a dovetail slot. Each of the plurality of third edge-associated female joints 232 may be located substantially along an edge of the upper portion of the third rectangular face 230 and may form tangential connection with an edge-associated male joint. One of the plurality of third edge-associated female joints 232 may be located on an edge defined by the third rectangular face 230 and the first square face 250. Said third edge-associated female joint 232 allows tangential connection with an edge-associated male joint along a direction that is normal to the surface of the third rectangular face 230. Two of the plurality of third edge-associated female joints 232 may be located on one edge defined by the third rectangular face 230 and the second rectangular face 220 and another edge defined by the third rectangular face 230 and the fourth rectangular face 240, respectively. The lower portion of the third rectangular face 230 includes a first lower rectangular face central female joint 234. The first lower rectangular face central female joint 234 is located centrally on or approximately centrally on the lower portion of the third rectangular face 230. The first lower rectangular face central female joint 234 may form penetrating connection with a male joint. The first lower rectangular face central female joint 234 may be a mortise hole.

The fourth rectangular face 240 includes an upper portion and a lower portion. The upper portion of the fourth rectangular face 240 includes a plurality of fourth edge-associated female joints 242. Each of the plurality of fourth edge-associated female joints 242 may be a dovetail slot. Each of the plurality of fourth edge-associated female joints 242 may be located substantially along an edge of the upper portion of the fourth rectangular face 240 and may form tangential connection with an edge-associated male joint. One of the plurality of fourth edge-associated female joints 242 may be located on an edge defined by the fourth rectangular face 240 and the first square face 250. Said fourth edge-associated female joint 242 allows tangential connection with an edge-associated male joint along a direction that is normal to the surface of the fourth rectangular face 240. Two of the plurality of fourth edge-associated female joints 242 may be located on one edge defined by the fourth rectangular face 240 and the third rectangular face 230 and another edge defined by the fourth rectangular face 240 and the first rectangular face 210, respectively. The lower portion of the fourth rectangular face 240 includes a second lower rectangular face central female joint 244. The second lower rectangular face central female joint 244 is located centrally on or approximately centrally on the lower portion of the third rectangular face 230. The second lower rectangular face central female joint 244 may form penetrating connection with a male joint. The second lower rectangular face central female 244 joint may be a mortise hole.

Some of the first to fourth edge-associated female joints 212, 222, 232, and 242 are formed such that two edge-associated female joints sharing an edge are integrated (herein referred as integrated edge-associated female joint). For example, a first edge-associated female joint 212 may be integrated with to second edge-associated female joint 222, a second edge-associated female joint 222 may be integrated with a third edge-associated female joint 232, a third edge-associated female joint 232 may be integrated with a fourth edge-associated female joint 242, and a fourth edge-associated female joint 242 may be integrated with a first edge-associated female joint 212. Such configuration allows an edge-associated male joint to mate with the integrated edge-associated female joint in two orientation. For example, an integrated edge-associated female joint defined by a first edge-associated female joint 212 and a second edge-associated female joint 222 may mate with an edge-associated male joint along a direction that is normal to the surface of the first rectangular face 210 or another direction that is normal to the surface of the second rectangular face 220.

The first square face 250 includes a square face central female joint 232. The square face central female joint 232 may be located centrally on or located approximately centrally on the first square face 250. The square face central female joint 232 may form penetrating connection to a male joint and allow disassembly only in an opposing, non-penetrating direction. The square face central female joint 232 may be a mortise hole. The first square face 250 further includes a plurality of square face edge-associated female joints. Each square face edge-associated female joint is located along or located substantially along an edge of the first square face 250 and may form tangential connection with an edge-associated male joint. The first square face 250 partially defines a first edge-associated female joints 212, a second edge-associated female joints 222, a third edge-associated female joints 232, and a fourth edge-associated female joints 242.

The second block 200 may further include a second square face (not illustrated) opposing the first square face. The second square face may be a flat surface or may define a hole (e.g., a mortise hole) conserve materials for building the second block 200.

In certain embodiments, each of one or more male joints of the first block 100 and/or the second block 200 may be structured such that the front portion of said male joint along the insertion direction is thinner than the rear portion of said male joint along the insertion direction, thereby reducing surface contacts and providing better error tolerance. For example, the central male 112 is structured such that the front portion of said male joint along the insertion direction is thinner than the rear portion of said male joint along the insertion direction.

Figure 3A:
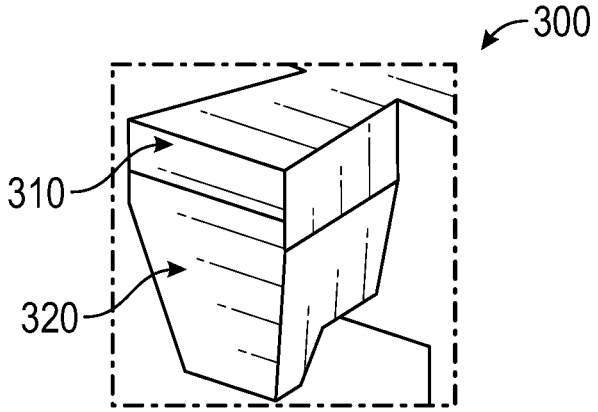
FIGS. 3A-3C illustrate various views of a modified edge-associated male joint.
Figure 3B:
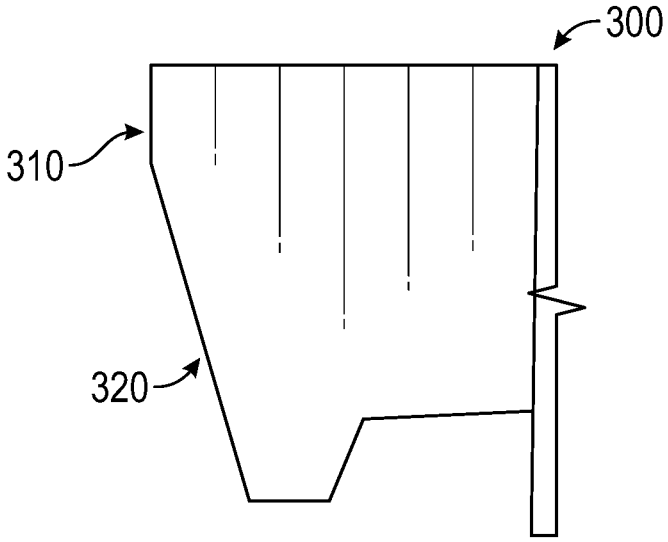
Figure 3C:
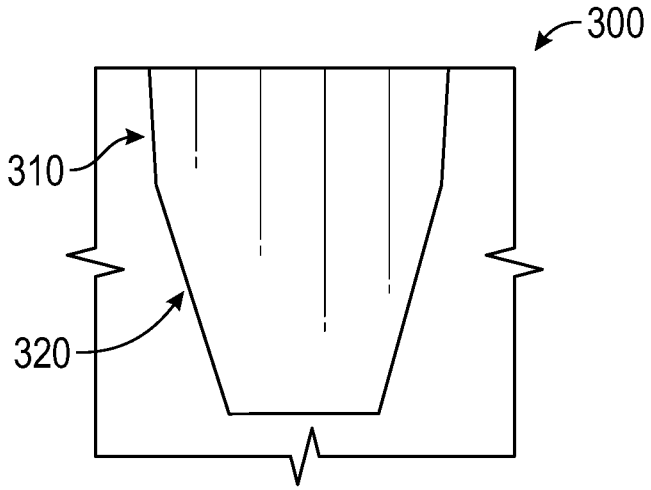

In certain embodiments, each of one or more edge-associated male joints of the first block 100 and/or the second block 200 may be structured such that a portion of said edge-associated male joint includes a shape of a trapezoidal prism while remaining portion of said edge-associated male joint includes a second different shape, thereby reducing surface contacts and providing better error tolerance. FIGS. 3A-3C illustrate various views of a modified edge-associated male joint 300. FIG. 3A illustrate a cropped, perspective view of the modified edge-associated male joint 300, FIG. 3B illustrate a cropped, side view of the modified edge-associated male joint 300, and FIG. 3C illustrate a cropped, front view of the modified edge-associated male joint 300. In the illustrated example, the modified edge-associated male joint 300 includes a first portion 310 having a shape of a trapezoidal prism. The modified edge-associated male joint 300 further includes a second different portion 320 extending from the first portion along the insertion direction. The second portion 320 may be thinner than the first portion 310. The second portion 320 may define a groove proximate to a portion of the modified edge-associated male joint 300 connected to a wall.

The process of constructing an interlocked structure using at least one first block 100 and at least one second block 200 will be described below. At least one memory may store an algorithm executable by at least one processor for generating a sequence of assembly orders for constructing the interlocked structure. The input to the algorithm may be a voxelized model describing the desired output shape of the interlocked structure. Herein, a voxel represents each unit of an array of elements of volume that constitute a notional three-dimensional space. Each voxel may be subdivided into a predetermined number of subvoxels. In certain embodiments, said predetermined number may be eight. Each subvoxel may be instantiated by a layer or a segment. A segment is defined by at least one square block. Herein, a square block refers to four interlocked blocks consisting two first blocks and two second block. A layer is defined by a set of square blocks having the same axis-coordinate (e.g., z-coordinate). Layer and segment labels allow assignment of joint types that connect adjacent layers or segments. Once the joint types have been assigned, layers or segments providing these joint types may be selected. The output of the algorithm is the sequence of assembly orders that constructs the interlocked structure shaped as the input model.

In certain embodiments, at least one first block 100 and at least one second block 200 may be assembled into a structure in order. Herein, the last block assembled in a structure and is removable from the remaining structure by reversing the most recent translation assembly motion is referred as a key block. The key block interlocks the overall structure unless it is removed from the remaining structure in the most recent translation assembly motion. Since the interlocked structure is built layer-by-layer, the final structure includes k keys, where k is the number of layers that do not have another layer on their top. In certain embodiments, an interlocked structure may be assembled layer-by-layer starting from bottom to top. In certain embodiments, the key block may be attached to the remaining structure by using glue, friction, at least one screw, or some other forms of connection.

Figure 4:
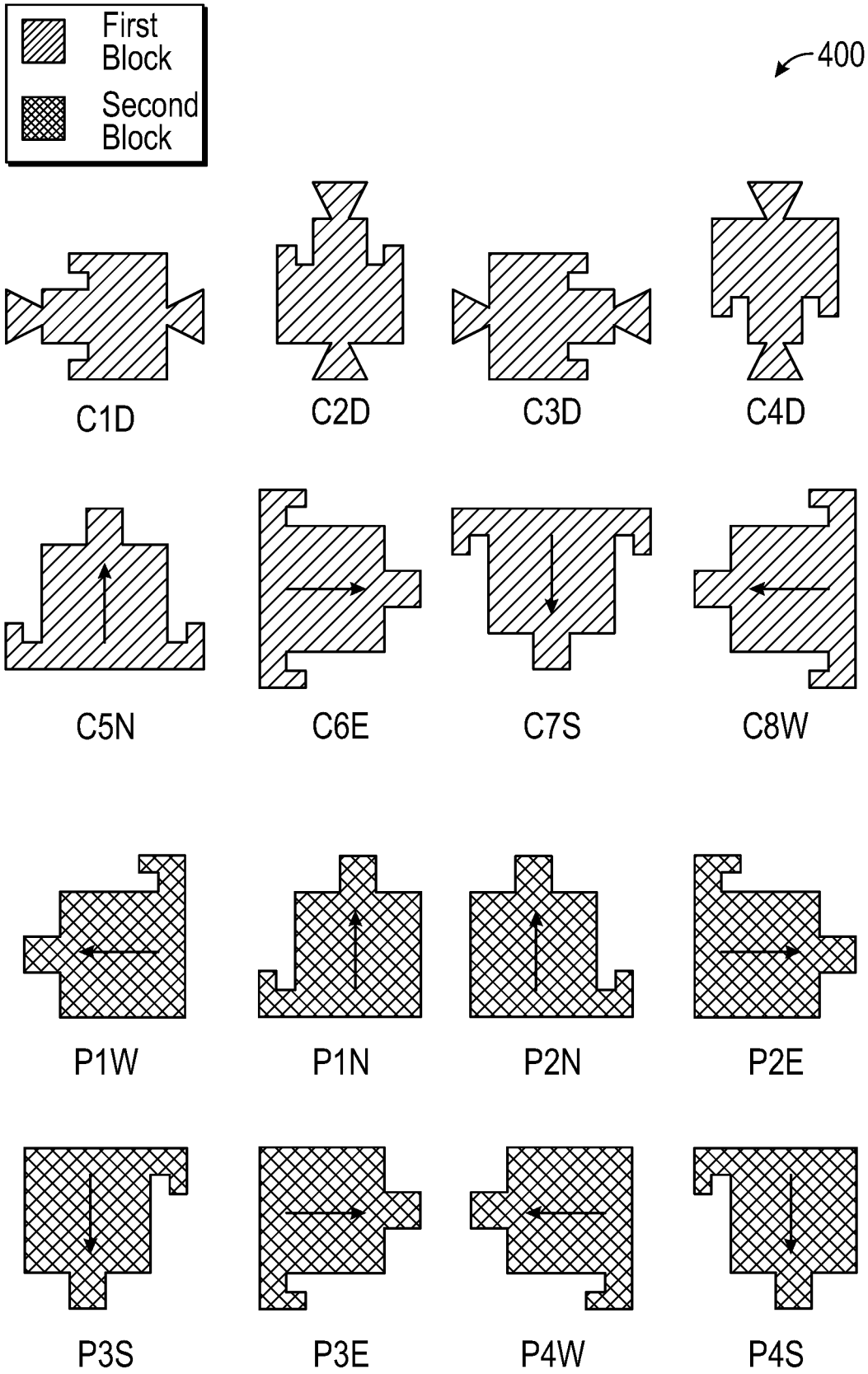
FIG. 4 illustrate notations for aiding in describing construction of an interlocked structure.

Example layout and assembly processes for constructing an interlocked structure including a square block, segment, and layer will be described in detail herein. FIG. 4 illustrate notations 300 to aid in describing said processes. For each first block 100 or second block, a triplet of characters indicate block type, orientation of the block, and assembly direction. "C" indicates "first block" and "P" indicates "second block." Numbers indicate orientations. "D" indicates "Down," "N" indicates "insert North," "E" indicates "East," "S" indicates "South," and "W" indicates "West." For example, C1D means "Cube in orientation 1, assembled by moving down." C1D, C2D, C3D, and C4D resemble plan views of orientations of the first block 100 in a X-Y plane having the first face facing into the illustration. C5N, C6E, C7S and C8 W resemble plan views of orientations of the first block 100 in a Z-Y plane having the fourth face facing into the illustration. P1W, P1N, P2N, P2E, P3S, PSE, P4W, and P4S resemble plan views of orientations of the second block 200 in a X-Y plane having the second square face facing into the illustration. P1W, P1N, P2N, P2E, P3S, PSE, P4W, and P4S resemble connections via the lower portion of the second block. Other notations of the second block 200 as illustrated in the figures herein resemble connection via the upper portion of the second block. The hooked protrusion as shown in P1W, P1N, P2N, P2E, P3S, PSE, P4W, and P4S resembles an instance in which one of the tenon tongues of the second block 200 forms a connection in a tangential direction. Not all axis-aligned orientations of the first block 100 and second block 200 are illustrated herein; for example, second block 200 only occur in the four orientations generated by rotating the second block 200 around the z-axis in ninety-degree increments.

Figure 5A:
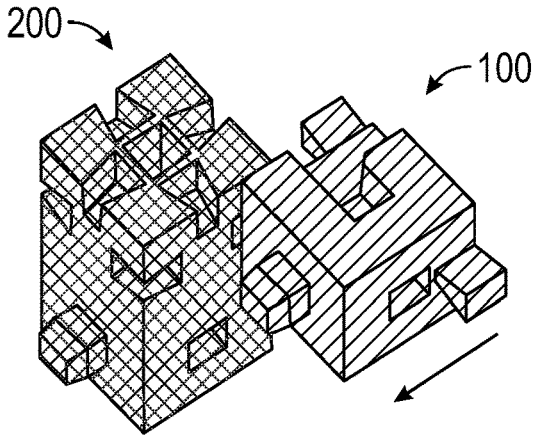
FIGS. 5A-5C illustrate perspective views for assembling a first square block.
Figure 5B:
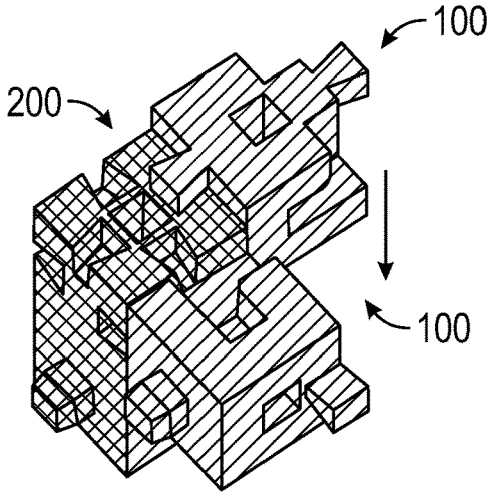
Figure 5C:
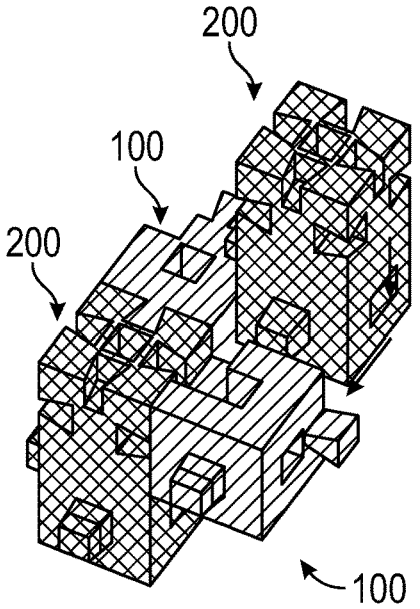
Figure 6:
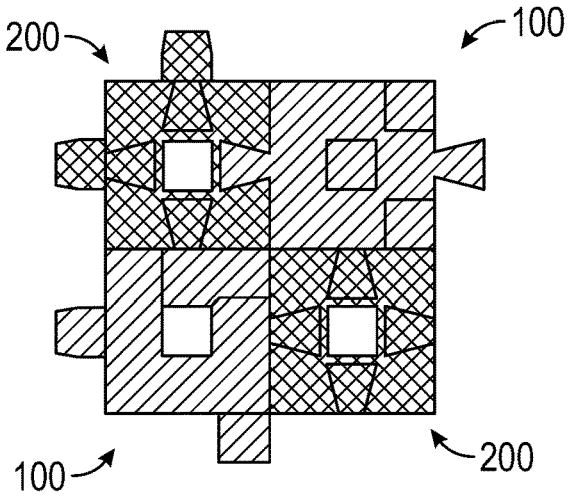
FIG. 6 illustrates a plan view of the first square block.
Figure 7:
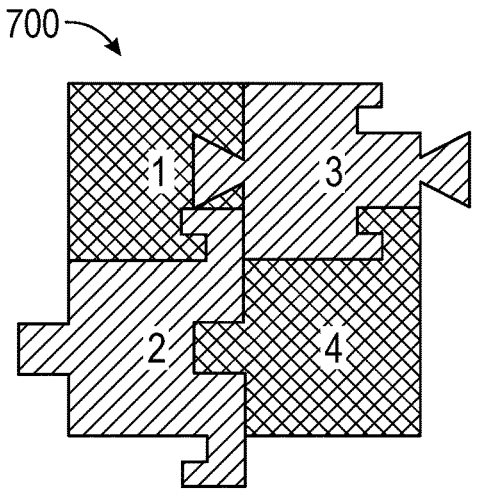
FIG. 7 illustrates a notational view for assembling the first square block.

FIGS. 5A-5C illustrate perspective views for assembling a first square block. FIG. 6 illustrates a plan view of the first square block, and FIG. 7 illustrates a first notational view 700 for assembling the first square block. Herein, a notational view illustrates a plan view of an interlocked structure using the notations as illustrated in FIG. 4. A notational view further includes numberings to indicate an order in which each block is assembled. The first square block may be constructed by using two first blocks 100 and two second blocks 200. The first square block may be constructed by sequentially performing the steps of: (1) providing a first one of the second blocks 200 in P1W or P1N orientation; (2) connecting one of the first blocks 100 with the upper portion of the third rectangular face 230 of the first one of the second blocks 200 in C8 W orientation and direction; (3) connecting a second one of the first blocks 100 with the upper portion of the fourth rectangular face 240 of the first one of the second blocks 200 in C3D orientation and direction; and (4) connecting a second one of the second blocks 200 with the two first blocks 100 in P1W orientation and direction. The second one of the second blocks 200 may function as the key block.

Figure 8:
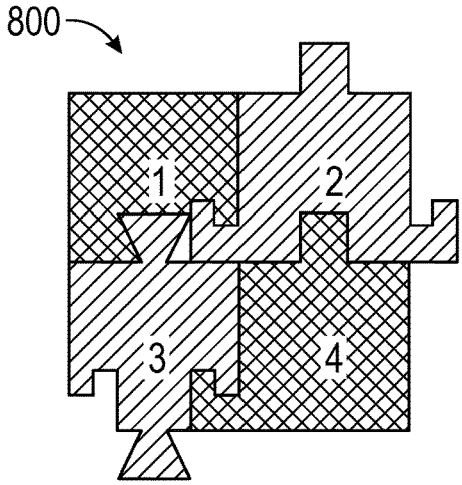
FIG. 8 illustrates a notational view for assembling a second square block.

FIG. 8 illustrates a second notational view 800 for assembling a second square block. The second square block may be constructed by using two first blocks 200 and two second blocks 200. The second square block may be constructed by sequentially performing the steps of: (1) providing a first one of the second blocks 200 in P1W or P1N orientation; (2) connecting one of the first blocks 100 with the upper portion of the fourth rectangular face 240 of the first one of the second blocks 200 in C5N orientation and direction; (3) connecting a second one of the first blocks 100 with the upper portion of the third rectangular face 230 of the first one of the second blocks 200 in C4D orientation and direction; and (4) connecting a second one of the second blocks 200 with the two first blocks 100 in P1N orientation and direction. The second one of the second blocks 200 may function as the key block.

Figure 9:
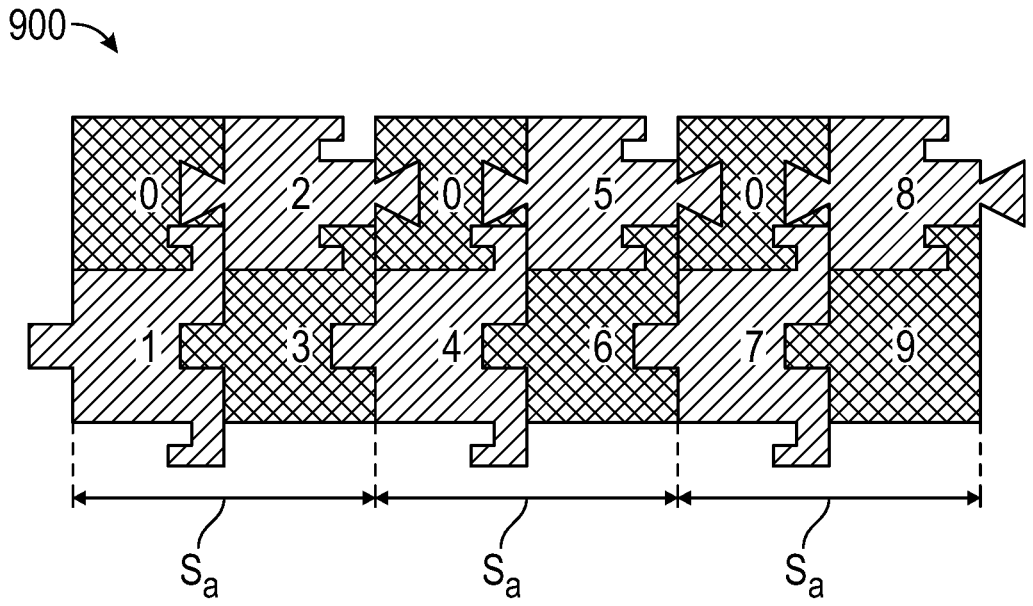
FIG. 9 illustrates a notational view for assembling a first segment.
Figure 10:
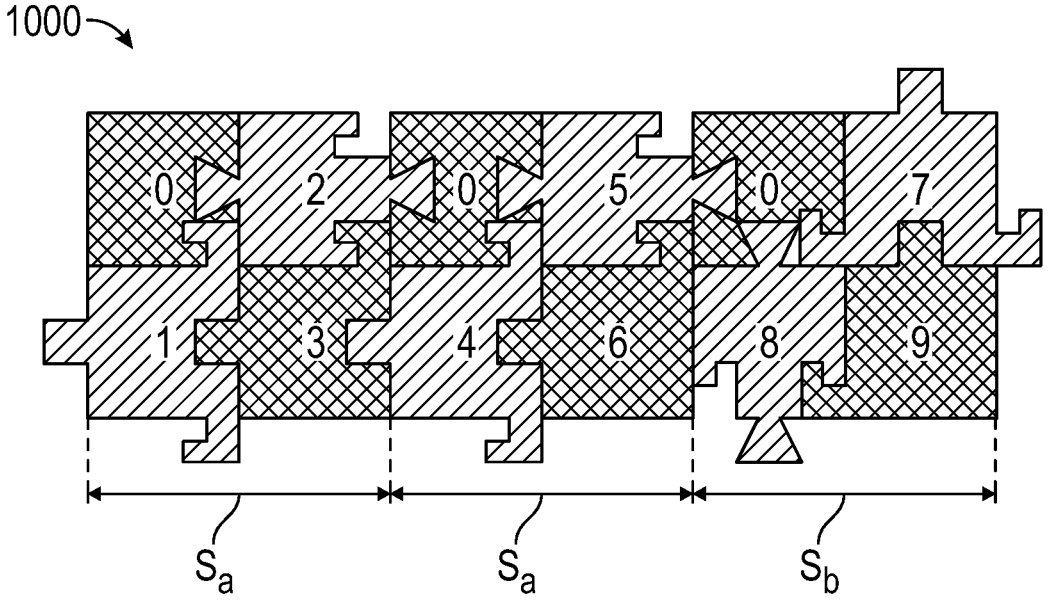
FIG. 10 illustrates a notational view for assembling a second segment.
Figure 11:
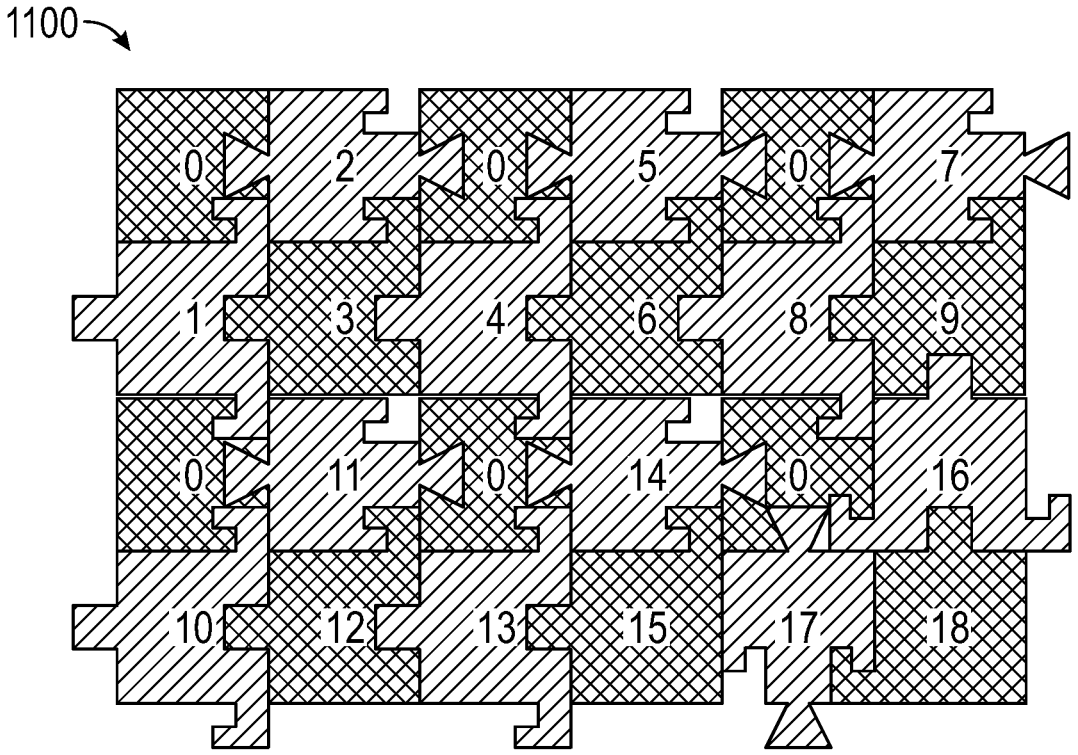
FIG. 11 illustrates the first and second segments interlocked to form a layer

FIGS. 9 and 10 illustrate third and fourth notational views 900 and 1000 for assembling a segment. As discussed above, a segment is defined by at least one square block. In certain embodiments, a segment may be composed of n square blocks in a 1×n pattern. A square block of a segment may be referred as a sub-segment. In certain embodiments, prior to formation of the segment, n number of second block 200 may be pre-placed in a prior layer, such that the top of each second post appears in the same position in each square block; these second blocks 200 allow the segment to interlock with the prior layer. In such embodiments, the segment may be assembled from left to right in the direction of the x-axis. For each square block, it is assumed that the x-axis and the y-axis is formed at the center of said square block. In this illustrated example, the second blocks 200 are in the upper (or y+) half of y-axis. Herein, a segment is labeled as $Y_l$+X+ if, for each square block, a second block 200 of the segment is in the left position of the y positive half and the segment is built towards the x-positive direction with the key block at the end. In the illustrated example, a $Y_{l+}X_+$ segment is formed using 3 square blocks. From left to right, n−1 $S_a$ squares may be formed. The last sub-segment may be a first square block or a second square block. FIG. 9 illustrates the third notational view 900 for assembling a first segment having the last sub-segment thereof as the first square block, and FIG. 10 illustrates the fourth notational view 1000 for assembling a second segment having the last sub-segment thereof as the second square block. The last assembled block is the key piece of the segment. The last sub-segment with the second square block is not interlocking, but when connected with previous segment(s), the Sb square prevents the adjacent square block in the y positive direction from moving and interlocks the structure. Building another $Y_{l+}X_+$ segment on the y negative side may create an interlocking layer. For example, FIG. 11 illustrates a fifth notational view 1100 for assembling the first and second segments to form a layer.

Figure 12:
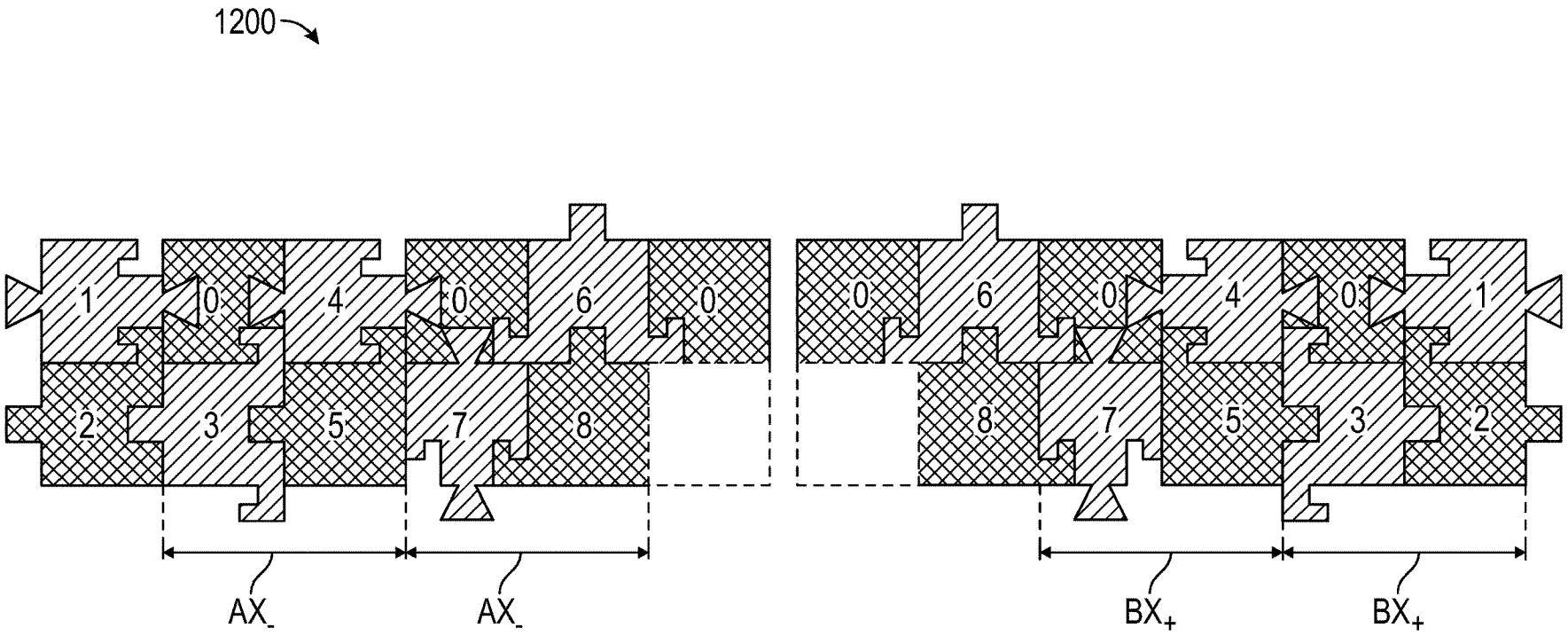
FIG. 12 illustrates a notational view for assembling an interlocked structure using a mirror operation.

FIG. 12 illustrate a sixth notational view 1200 for assembling an interlocked structure and a mirrored replica of the interlocked structure using a mirror operation. A mirror operation may be defined based on position and orientation of a reflection plane with respect to an axis. For example, an x-mirror operation may define an object A as an x-mirror, $m_x$(B), of another object B if one is a reflection of the other with reflection plane perpendicular to the x-axis, and a y-mirror operation may define an object A as an y-mirror, $m_y$(B), of another object B if one is a reflection of the other with reflection plane perpendicular to the y-axis. Designs rendered using first block 100 and second block 200 are symmetric in such a way that x and y mirror operations can be accomplished by simple rotation of the block. Construction of a mirrored structure follows the same order of the original structure with opposite directions along the same axis; for example, a $Y_r$+X− segment may be built by x-mirroring a $Y_{l+}X_+$ segment. As shown in the illustrated example, other types of segments for layer construction may further include a $Y_{r+}X_+$ (i.e., the left segment) and its x-mirror $Y_{l+}X_-$ (i.e., the right segment). A $Y_{r+}X_+$ segment with n square blocks, where n≥2, may be assembled with first and second blocks 200 (C3D and P1W) in the left two positions. Subsequently, a $Y_{l+}X_+$ segment of n−1 square blocks may be assembled. When all pre-existing second blocks 200 are prevented from moving along z axis, the segment is interlocked. In certain embodiments, it may turn out that neither end of a segment is adjacent to the next segment, causing a key block to be exposed.

Figure 13:
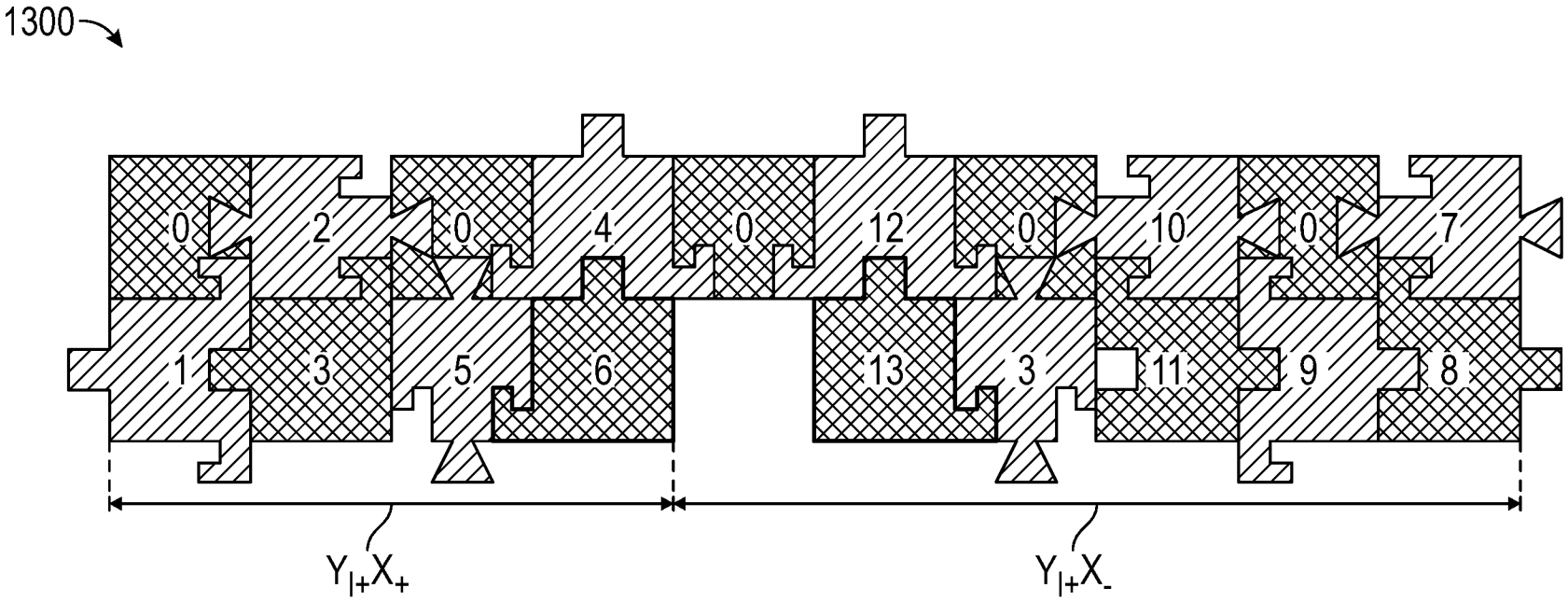
FIG. 13 illustrates a notational view for assembling a mirrored pair of interlocked structure having a pair of key blocks.

FIG. 13 illustrates a seventh notational view 1300 for assembling a mirrored pair of interlocked structure having a pair of key blocks. In the illustrated example, a single segment may be replaced by two segments grown from the ends, effectively allowing placement of a pair of key blocks (see blocks having bolded outlines in FIG. 13) at an arbitrary position in the middle. These key blocks may then be immobilized by later segments.

The initial step for constructing an interlocking structure includes determining one or more key blocks of the layer. A layer is immobilized if one or more key blocks is fixed with respect to its neighbors. Since every even layer has an upper layer with the exact same shape, based on the division of voxels into subvoxels, second blocks 200 that connect the upper layer will be immobilized as long as the upper layer is interlocked, preventing the horizontal motion of any second blocks. As discussed above, a layer is a set of square blocks having the same axis-coordinate (e.g., z-coordinate). A set of connected square blocks having the same axis-coordinate will be referred herein as a layer component. For any odd layer component without adjacent upper layer blocks, a second block 200 may be selected at the x negative end of a boundary segment as the key, where a boundary segment is a segment with adjacent neighbors on only one side. If the odd layer component has an adjacent upper layer, the key block may be any post block covered by an upper layer square. Under this rule, every layer component constrains the key block to its lower component. Any layer components that do not have an immediate upper layer introduce a new key block that will not be covered. Thus, as discussed above, the number of key pieces of the whole structure is the number of layer components without an immediate upper layer.

Once a layer's key square blocks and all starting second blocks 200 are identified, the second step for constructing an interlocking structure includes determining the order and type of each segment. At the outset, every voxel of the voxelized model is broken into two square blocks, making every layer of voxels two layers in the assembly. The bottom layer has an even z-coordinate value, while the upper layer has an odd z-coordinate. Every segment in an even layer is constructed along y-axis directions. The segments in the even layer may be assembled as $X_{l-}Y_{+}$, or 90° clockwise rotation of a $Y_{r+}X_{-}$ segment, from left to right. An even layer component is not necessarily interlocked, because there can be many segment keys unconstrained and able to move in the x positive direction. However, all key blocks are second blocks 200 in the upper layer, and as long as the upper layer is interlocked, or all second blocks 200 are prevented from moving in x positive direction, the two-layer structure is interlocked. Each square block in an odd layer component is initially assumed to have a second block 200 in the bottom-right position. This, however, could change after the segment types have been assigned. At first, a set of second block 200 lists may be determines, where each list contains second blocks 200 with the same y-coordinate, and two adjacent second blocks 200 are 2 units away. Each list may be built into a segment. Two second blocks 200 are considered adjacent if their x or y-coordinates have a difference of 2. Two lists are considered adjacent they have adjacent posts. Lists are ordered by their shortest distances to the final list that contains the second block 200 of the key square block, where the distance between two adjacent lists is l. Given a list l and the next-built adjacent list $l_n$, the type of the segment Sl associated with l is determined as described below: (1) if $l_n$ is at y− side of l & the left end second block 200 of l is adjacent to $l_n$, $S_l$ is $Y_{r+}X_{-}$; (2) if $l_n$ is at y− side of l & the right end second block 200 of l is adjacent to $l_n$, $S_l$ is $Y_{r}+X_{+}$; (3) if $l_n$ is at y− side of l & neither ends of l is adjacent to $l_n$, $S_l$ is broken into a $Y_{r+}X_{-}$ and a $Y_{r+}X_{+}$ segment; (4) if $l_n$ is at y positive side of l & the left end post of l is adjacent to $l_n$, $S_l$ is $Y_{r-}X_{-}$; (5) if $l_n$ is at y positive side of l & the right end second block 200 of l is adjacent to $l_n$, $S_l$ is $Y_{r-}X_{+}$; and (6) if $l_n$ is at y positive side of l & neither ends of l is adjacent to $l_n$, $S_l$ is broken into a $Y_{r-}X_{-}$ and a $Y_{r-}X_{+}$ segment. The segment associated with the last built list has been specified a key block. Therefore, its type is determined.

At this point, the type of each segment and the order of construction in each layer has been selected. Many interlocking layer structures can be assembled by directly following the construction of each segment as specified in above embodiments. However, depending on the successor segments, certain modifications may be further applied to insure the interlocking of adjacent segments.

For example, a successor segment of a $Y_{l+}X_{+}$ segment having one or more key blocks in the y negative side may be: (1) a segment whose key block is constrained by further segments in y negative side; (2) a segment with key being constrained in y positive side; or (3) a segment whose key block is constrained by the upper layer.

In the first case, the $Y_{l+}X_{+}$ segment is followed by another $Y_{l+}X_{+}$ segment. A second square block may be provided at the later built segment to prevent the segment's key block from moving (e.g., see FIG. 11). Otherwise, a $Y_{l+}X_{+}$ segment always uses a first square block.

Figure 14:
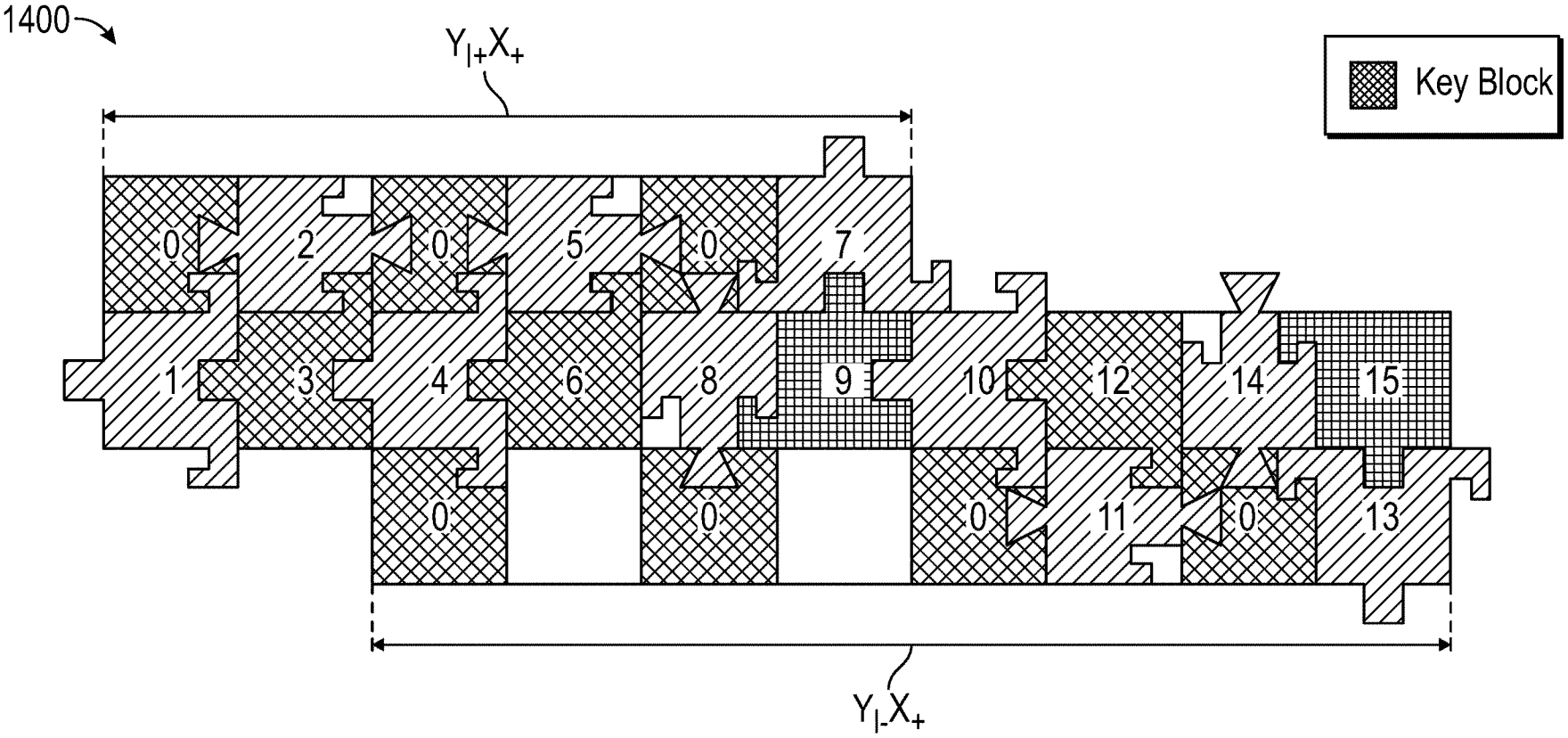
FIG. 14 illustrates a first example case in which additional modification is applied to an interlocked structure.
Figure 15:
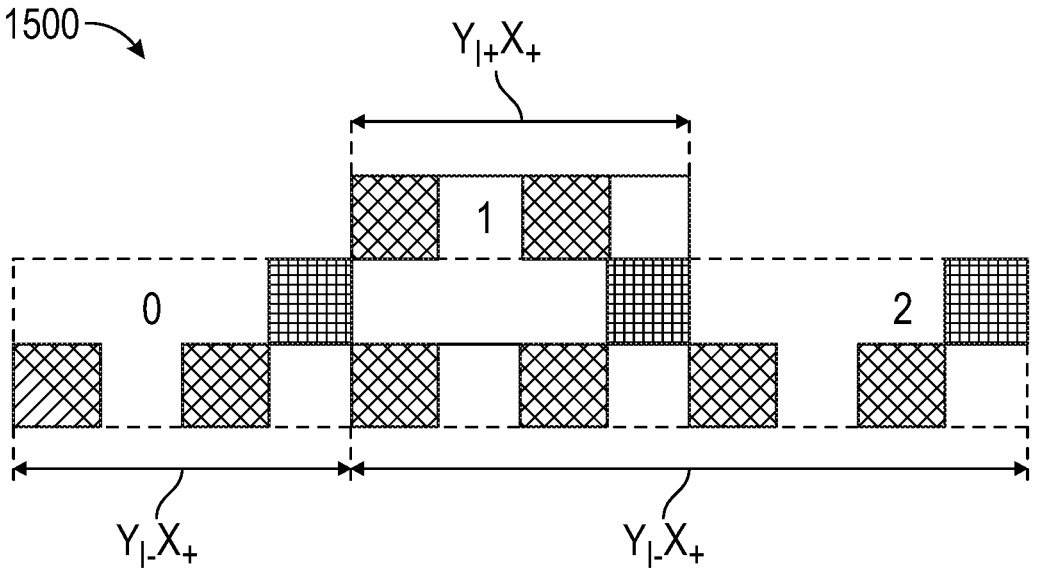
FIG. 15 illustrates a second example case in which additional modification is applied to an interlocked structure.

In the second case, four subcases where the current segment has one or both ends adjacent to its successor segment whose key is in the x positive or negative side are provided. FIG. 14 illustrates a first subcase 1400. In the illustrated example, a $Y_{l-}X_{+}$ segment is built after a $Y_{l+}X_{+}$ segment. Some of the positions in the $Y_{l-}X_{+}$ segment are left empty. FIG. 15 illustrates a second similar subcase 1500 where both ends of the segment are adjacent to the successor. In the illustrated example, a $Y_{l-}X_{+}$ segment and a $Y_{l+}X_{+}$ segment are provided. The $Y_{l-}X_{+}$ segment is broken into two segments, where one is longer than the other. In this subcase, a modification may be applied such that: a lower segment is divided into two segments, one of the segments containing no second block 200 adjacent to the upper segment is built first, and the other segment containing the remaining second blocks 200 is built after the upper segment. In another subcase, the successor segment includes a key block in the x negative direction. In this subcase, a modification may be applied such that the upper segment is changed to $Y_{l+}X_{-}$. In another subcase, an x-mirror of the previous case is created.

Figure 16:
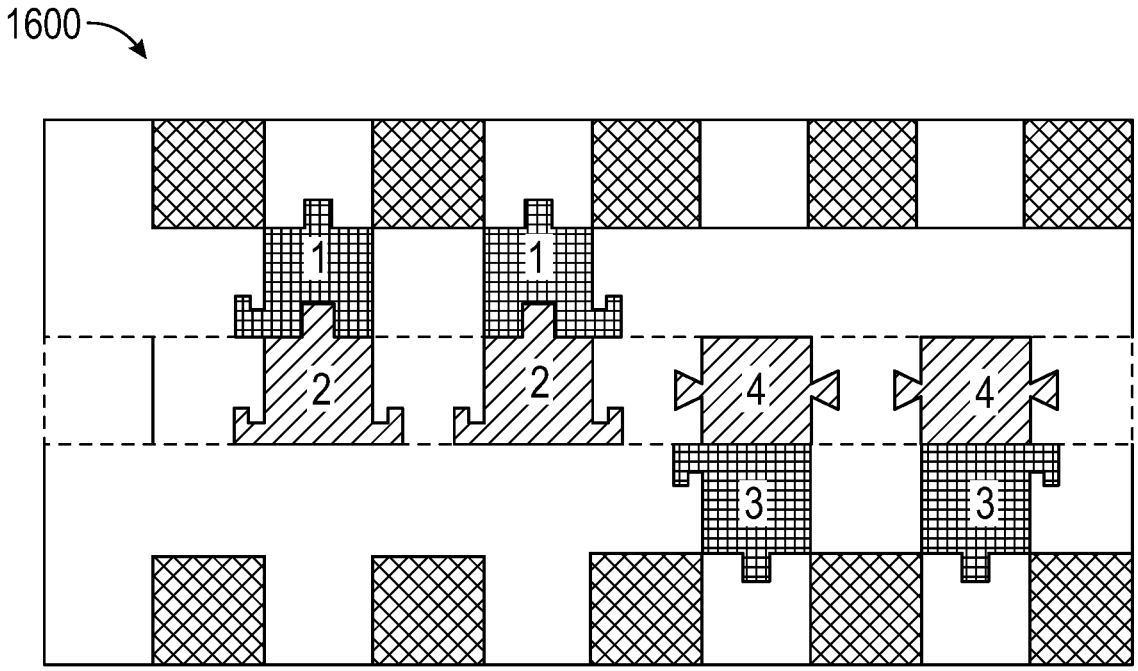
FIG. 16 illustrates a third example case in which additional modification is applied to an interlocked structure.

FIG. 16 illustrates the third case 1600. In this example, a $Y_{r+}X$ segment and a $Y_{r-}X$ segment are assembled before the segment in the middle. The upper and lower segments' key blocks are assembled be in different x positions. To ensure interlocking, the upper segment is first assembled, then two C5N blocks in the middle segment are assembled. After the lower segment is assembled, C3D blocks are assembled in the middle to constrain the motion of the lower segment key blocks. The last assembled key blocks in the middle are constrained by its upper layer. If the upper layer is not wide enough to cover the keys, the upper layer may be modified to expand.

In certain scenarios, laying out blocks one-by-one is time-consuming when a voxelized model requires a large number of blocks. In certain embodiments, the construction process may be performed in a parallel construction order to accelerate the process. In the parallel construction order, preliminaries for assembling each block may be first determined, and a graph between blocks may be further determined. By querying the graph for blocks whose preliminaries are satisfied, multiple agents may lay out the blocks.

For example, it is assumed that a block b is to be assembled in a layer. Any adjacent block(s) to be assembled later should not be prevented by the male joint(s) of b, meaning the joints of a block connect to only the pre-existing blocks. Along the assembly direction of b, the male joints of b should not be able to touch any blocks. The blocks that must be assembled before a new block to prevent collision are referred herein as predecessors of the new block. Every block has a predecessor below it if an adjacent block exists in the lower layer. Consider a block at position (x,y) in any layer. Table 1 is a list of predecessors of different types of blocks in the same layer.

TABLE 1

Predecessors of each type of block.

| Block type | Predecessors |
|---|---|
| C1D, C3D | (x − 1, y), (x + 1, y) |
| C2D, C4D | (x, y − 1), (x, y + 1) |
| C5N | (x − 1, y), (x + 1, y), (x, y + 1) |
| C6E | (x, y + 1), (x, y − 1), (x + 1, y) |
| C7S | (x − 1, y), (x + 1, y), (x, y − 1) |
| C8W | (x, y + 1), (x, y − 1), (x − 1, y) |
| P1W, P1N | (x − 1, y), (x, y + 1) |
| P2N, P2E | (x, y + 1), (x + 1, y) |
| P3S, P3E | (x + 1, y), (x, y − 1) |
| P4W, P4S | (x − 1, y − 1), (x, y) |

Besides predecessors listed above, inside each square block, first blocks 100 with mortise joints connecting blocks in the same layer (C5N, C6E, C7S or C8 W blocks) must be assembled before others (C1D, C2D, C3D or C4D blocks). With the predecessors of each block, a directed graph G={V,E} may be constructed, where V is the set of blocks, and directed edge $e_{i,j}$€E indicates block i being a predecessor of block j. The construction follows the order of removing nodes with in-degree of 0. Each construction agent/thread may take a block whose predecessors have been placed, and remove the node from the graph when the block assembly is finished. That is, after the construction of one square block, all the adjacent square blocks that after said square block are ready to be assemble in sequential order. In certain embodiments, parallel construction of a solid cube of N squares may require $O(\sqrt[3]{N})$ time. For instance, a solid layer of n×n square blocks may be scaled such that the width of each square block is scaled to one. After assembling the square block at the corner (0,0), two adjacent square blocks in x and y positive directions may be assembled at the next time step, then three, four, and so on. Assuming it takes k steps to construct k(k+1)/2 squares, when k=n, over $n^2/2$ squares are constructed, the number of steps for constructing a layer takes at most 2n steps. In a cube, since finishing every square allows all adjacent square blocks in x, y and z positive directions to assemble, it may take one more step to finish the upper layer when the last square of the bottom layer is assembled. So 2n−1 more steps may finish all upper layers. Therefore, a solid cube of 2n×n×n squares takes $O(n)=O(\sqrt[3]{N})$ time to assemble.

Figure 17:
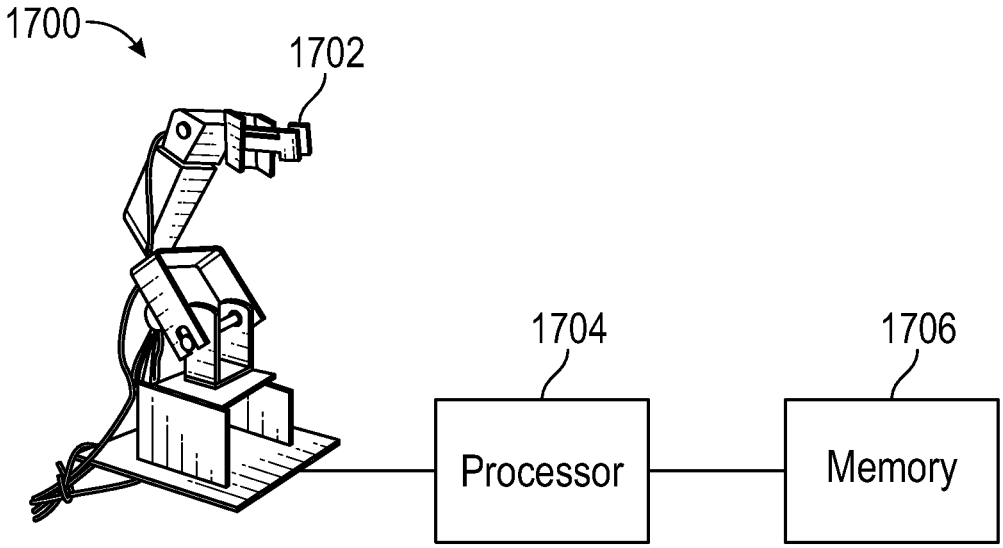
FIG. 17 illustrates an example system for assembling an interlocked structure.

FIG. 17 illustrates an example system 1700 for assembling an interlocked structure. The system 1700 includes at least one assembling device 1702, at least one processor 1704, and at least one memory 1706. Said assembling device 1702, processor 1704, and memory 1706 are communicatively coupled to each other. The assembling device 1702 is operable to adjust position and orientation of at least one first block 100 and/or at least one second block. The assembling device 1702 may include a robotic device such as robot arm. For example, the robot arm may be a 4-DoF Adept robot arm. The processor 1704 may be any suitable processing device or set of processing devices such as, but not limited to: a microprocessor, a microcontroller-based platform, a suitable integrated circuit, one or more field programmable gate arrays (FPGAs), and/or one or more application-specific integrated circuits (ASICs). The memory 1706 may be volatile memory (e.g., RAM, which can include non-volatile RAM, magnetic RAM, ferroelectric RAM, and any other suitable forms), non-volatile memory, unalterable memory, read-only memory, and/or high-capacity storage devices. In some examples, the memory 1706 includes multiple kinds of memory, particularly volatile memory and non-volatile memory. The memory 1706 is computer readable media on which one or more sets of instructions, such as the software for operating the methods of the present disclosure can be embedded. The instructions may embody one or more of the methods or logic as described herein. In a particular embodiment, the instructions may reside completely, or at least partially, within any one or more of the memory, the computer readable medium, and/or within the processor during execution of the instructions. The terms "non-transitory computer-readable medium" and "tangible computer-readable medium" should be understood to include a single medium or multiple media, such as a centralized or distributed database, and/or associated caches and servers that store one or more sets of instructions. The terms "non-transitory computer-readable medium" and "tangible computer-readable medium" also include any tangible medium that is capable of storing, encoding or carrying a set of instructions for execution by a processor or that cause a system to perform any one or more of the methods or operations disclosed herein. As used herein, the term "tangible computer readable medium" is expressly defined to include any type of computer readable storage device and/or storage disk and to exclude propagating signals. The memory 1706 may store instructions executable by the processor 1704 for causing the assembling device 1702 to assemble any of the interlock structure as described in the disclosure herein. The memory 1706 may further store data and/or instructions for processing an input voxelized model describing a desired output shape of an interlocked structure and providing an output sequence of assembly orders that constructs the interlocked structure shaped as the input model.

Figure 18:
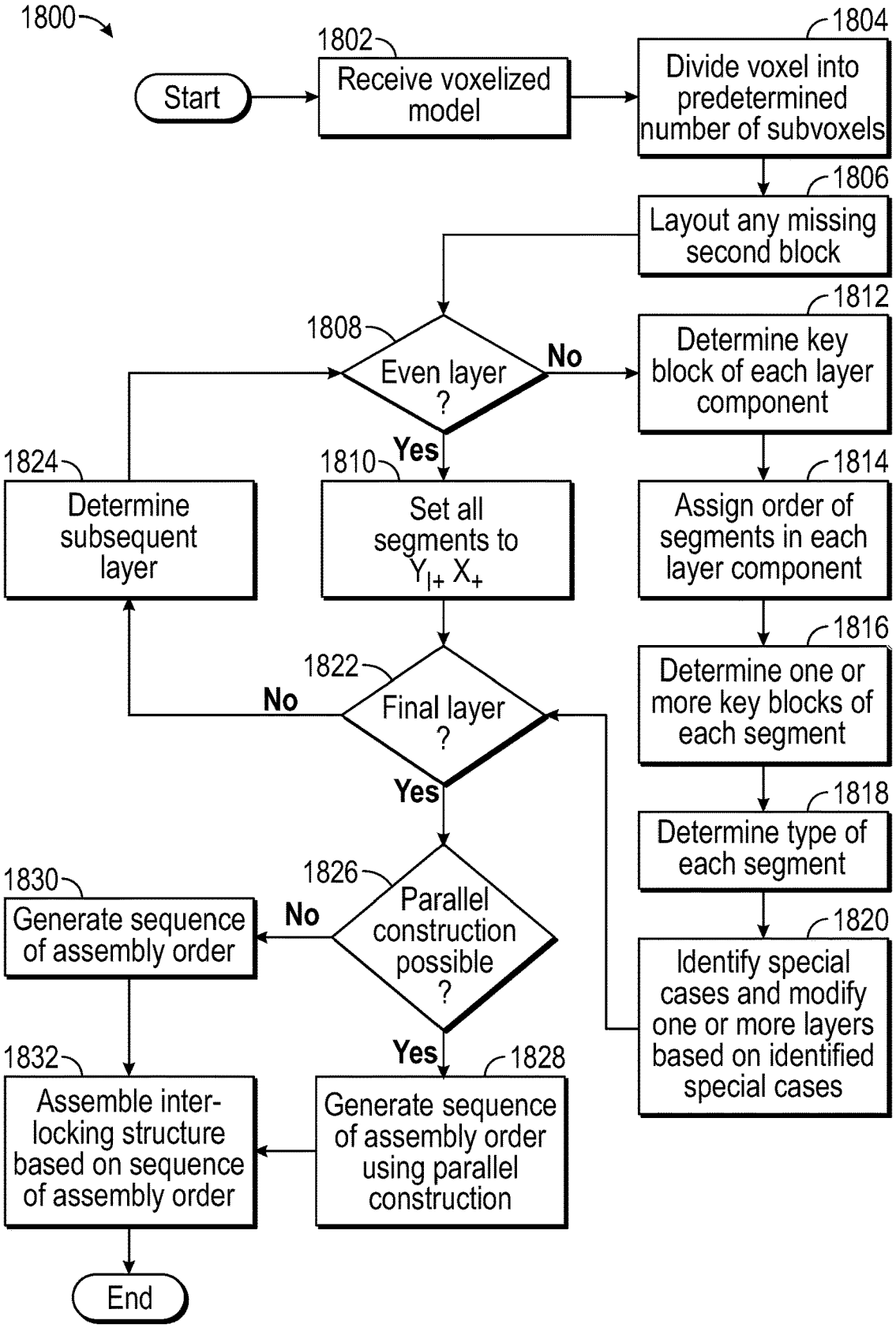
FIG. 18 illustrate a flowchart of a method for assembling an interlocked structure.

FIG. 18 illustrate a flowchart 1800 of a method for assembling an interlocked structure, which may be implemented by the system of FIG. 17.

At block 1802, the processor 1702 receives, from a source (e.g., via an input device, another computing device, external server, etc.), a voxelized model indicative of a desired output shape of the interlocked structure.

At block 1804, the processor 1702 divides the voxel into a predetermined number of subvoxels. For example, the predetermined number may be eight.

At block 1806, the processor 1702, for each layer of each subvoxels, starting from bottom to top, lays out any second block 200 missing from said layer.

At block 1807, the processor 1702 determines whether the current layer is an even layer. If so, the method continues to block 1710. Otherwise, the method continues to block 1812.

At block 1812, the processor 1702 determines all the key blocks of each layer component.

At block 1814, the processor 1702 assigns the order of segments in each layer component.

At block 1816, the processor 1702 determines one or more key blocks of each segment.

At block 1818, the processor 1702 determines the type of each segment.

At block 1820, the processor 1702 identifies one or more special cases (e.g., cases as described above with reference to FIGS. 11 and 14-16) and modifies one or more layers based on the identified special cases.

At block 1822, the processor 1702 determines whether the current lay is the final layer of the interlocked structure. If so, the method continues to block 1826. Otherwise, the method continues to block 1824.

At block 1824, the processor 1702 determines the subsequent layer of the interlocked structure.

At block 1826, the processor 1702 determines whether parallel construction is possible for assembling the interlocked structure. If so, the method continues to block 1827. Otherwise, the method continues to block 1830.

At block 1827, the processor 1702 generates a sequence of assembly order using the parallel construction process.

At block 1830, the processor 1702 generates a sequence of assembly order.

At block 1832, the processor 1702 causes the assembling device to assemble the interlocking structure based on the sequence of assembly order.

The flowchart of FIG. 18 is representative of machine readable instructions stored in memory (such as the memory 1706 of FIG. 17) that comprise one or more programs that is executable by a processor (such as the processor 1704 of FIG. 17). Further, although the example program(s) is/are described with reference to the flowchart illustrated in FIG. 17, many other methods may alternatively be performed. For example, the order of execution of the blocks may be changed, and/or some of the blocks described may be changed, eliminated, or combined.

In this application, the use of the disjunctive is intended to include the conjunctive. The use of definite or indefinite articles is not intended to indicate cardinality. In particular, a reference to "the" object or "a" and "an" object is intended to denote also one of a possible plurality of such objects. Further, the conjunction "or" may be used to convey features that are simultaneously present instead of mutually exclusive alternatives. In other words, the conjunction "or" should be understood to include "and/or". As used here, the terms "module" and "unit" refer to hardware with circuitry to provide communication, control and/or monitoring capabilities, often in conjunction with sensors. "Modules" and "units" may also include firmware that executes on the circuitry. The terms "includes," "including," and "include" are inclusive and have the same scope as "comprises," "comprising," and "comprise" respectively.

The above-described embodiments, and particularly any "preferred" embodiments, are possible examples of implementations and merely set forth for a clear understanding of the principles of the invention. Many variations and modifications may be made to the above-described embodiment(s) without substantially departing from the spirit and principles of the techniques described herein. All modifications are intended to be included herein within the scope of this disclosure and protected by the following claims.

What is claimed is:

1. A set of interlocking blocks consisting of:

a. a plurality of first blocks, each first block having a substantially cubic shape and six faces, the six first block faces including:

i. a first face including a central male joint, the central male joint located approximately centrally on the first face and configured for penetrating connection to a female joint;

ii. a second face including a central female joint, the central female joint located approximately centrally on the second face, configured for penetrating connection to a male joint, and allowing for disassembly only in an opposing non-penetrating direction;

iii. a third face including a first edge-associated male joint, the first edge-associated male joint located substantially along an edge of the third face and configured for tangential connection to an edge-associated female joint; and iv. a fourth face including a first open-ended female joint, the first open-ended female joint configured for penetrating or tangential connection to a male joint and allowing for disassembly in an opposing non-penetrating direction or an opposing tangential direction; and b. a plurality of second blocks, each second block having a substantially square cuboid shape and six face, the six second block faces including i. a first rectangular face having an upper portion and a lower portion, the upper portion of the first rectangular face including a plurality of first edge-associated female joints, each first edge-associated female joint located substantially along an edge of the upper portion of the first rectangular face and configured for tangential connection to an edge-associated male joint; and the lower portion of the first rectangular face including a lower rectangular face central male joint, the lower rectangular face central male joint located approximately centrally on the lower portion of the first rectangular face and configured for penetrating connection to a female joint;

ii. a second rectangular face having an upper portion and a lower portion, the upper portion of the second rectangular face including a plurality of second edge-associated female joints, each second edge-associated female joint located substantially along an edge of the upper portion of the second rectangular face and configured for tangential connection to an edge-associated male joint; and the lower portion of the second rectangular face including a lower rectangular face central female joint, the lower rectangular face central female joint located approximately centrally on the lower portion of the second rectangular face, configured for penetrating connection to a male joint, and allowing for disassembly only in an opposing, non-penetrating direction; and iii. a first square face including a square face central female joint, the square face central female joint located approximately centrally on the first square face, configured for penetrating connection to a male joint, and allowing for disassembly only in an opposing, non-penetrating direction; and a plurality of square face edge-associated female joints, each square face edge-associated female joint located substantially along an edge of the first square face, configured for tangential connection to an edge-associated male joint.

2. The set of interlocking blocks of claim 1, wherein each first block further comprises:

v. a fifth face including a second edge-associated male joint, the second edge-associated male joint located substantially along an edge of the fifth face and configured for tangential connection to an edge-associated female joint.

3. The set of interlocking blocks of claim 2, wherein each first block further comprises:

vi. a sixth face including a second open-ended female joint, the second open-ended female joint configured for penetrating or tangential connection to a male joint and allowing for disassembly in an opposing non-penetrating direction or an opposing tangential direction.

4. The set of interlocking blocks of claim 1, wherein the first face and the second face are on opposing sides of the first block.

5. The set of interlocking blocks of claim 2, wherein the third face and the fifth face are on opposing sides of the first block.

6. The set of interlocking blocks of claim 3, wherein the fourth face and the sixth face are on opposing sides of the first block.

7. The set of interlocking blocks of claim 1, wherein each second block further comprises:

iv. a third rectangular face having an upper portion and a lower portion, the upper portion of the third rectangular face including a plurality of third edge-associated female joints, each third edge-associated female joint located substantially along an edge of the upper portion of the third rectangular face and configured for tangential connection to an edge-associated male joint; and the lower portion of the third rectangular face including a lower rectangular face central male joint, the lower rectangular face central male joint located approximately centrally on the lower portion of the third rectangular face and configured for penetrating connection to a female joint.

8. The set of interlocking blocks of claim 7, wherein the first rectangular face and the third rectangular face are on adjacent sides of the second block.

9. The set of interlocking blocks of claim 7, wherein each second block further comprises:

v. a fourth rectangular face having an upper portion and a lower portion, the upper portion of the fourth rectangular face including a plurality of fourth edge-associated female joints, each fourth edge-associated female joint located substantially along an edge of the upper portion of the fourth rectangular face and configured for tangential connection to an edge-associated male joint; and the lower portion of the fourth rectangular face including a lower rectangular face central female joint, the lower rectangular face central female joint located approximately centrally on the lower portion of the fourth rectangular face, configured for penetrating connection to a male joint, and allowing for disassembly only in an opposing, non-penetrating direction.

10. The set of interlocking blocks of claim 9, wherein the second rectangular face and the fourth rectangular face are on adjacent sides of the second block.

11. A method for robotically assembling an apparatus, the method comprising:

connecting two first blocks of claim 1 to the upper portion of a post, wherein the post is a second block of claim 1 in diagonal positions of a 2×2 grid; and connecting a further second block of claim 1 to each of the two first blocks in a diagonal position to the post.

12. A method for robotically assembling an apparatus, the method comprising:

providing two first blocks, block A and block B, of claim 1;

providing two second blocks, block C and block D, of claim 1;

connecting block A to block C via the first edge-associated male joint of the third face of block A and one of the first or second edge-associated female joint of the respective first or second rectangular face of block C;

connecting block B to block C via the first edge-associated male joint of the third face of block B and one of the square face edge-associated female joints of the first square face of block C; and substantially simultaneously connecting block D to blocks A and B via (i) the lower rectangular face central male joint of the lower portion of the third rectangular face of block D and the central male joint of the first face of block A and (ii) the lower rectangular face central male joint of the lower portion of the first rectangular face of block D and the first open-ended female joint of the fourth face of block B.

13. The set of interlocking blocks of claim 1, comprising at least one square block, wherein each square block consists two of the plurality of first blocks and two of the plurality of second blocks.

14. The set of interlocking blocks of claim 13, wherein the two of the plurality of first blocks and the two of the plurality of second blocks are arranged in a 2×2 grid.

15. The set of interlocking blocks of claim 14, wherein the two of the plurality of second blocks are diagonally arranged in the 2×2 grid.

16. The set of interlocking blocks of claim 13, wherein the two of the plurality of second block are arranged in the same orientation.

17. The set of interlock blocks of claim 13, wherein the two of the plurality of first blocks are block A and block B and two of the plurality of second blocks are block C and block D, wherein block A is connected to block C via the first edge-associated male joint of the third face of block A and one of the first or second edge-associated female joint of the respective first or second rectangular face of block C, wherein block B is connected to block C via the first edge-associated male joint of the third face of block B and one of the square face edge-associated female joints of the first square face of block C, and wherein block D is connected to blocks A and B via (i) the lower rectangular face central male joint of the lower portion of the third rectangular face of block D and the central male joint of the first face of block A and (ii) the lower rectangular face central male joint of the lower portion of the first rectangular face of block D and the first open-ended female joint of the fourth face of block B.

18. The set of interlock blocks of claim 13, wherein each of the central male joint, the central female joint, the lower rectangular face central male joint, the lower rectangular female joint, and the square face central female joint is configured to form a mortise and tenon joint.

19. The set of interlock blocks of claim 13, wherein each of the first edge-associated male joint, the plurality of first edge-associated female joints, the plurality of second edge-associated female joints, and the plurality of square face edge-associated joints is configured to form a dovetail joint.

20. The set of interlock blocks of claim 13, wherein the first open-ended female joint is a partial mortise hole configured to partially surround sidewalls of a tenon tongue.

21. The set of interlock blocks of claim 13, wherein each of the central male joint and the lower rectangular face central male joint is a tenon tongue comprising a top portion and a base portion thinner than the top portion.

* * * * *